US008840221B2

(12) United States Patent
Horikawa et al.

(10) Patent No.: US 8,840,221 B2
(45) **Date of Patent: *Sep. 23, 2014**

(54) IMAGE FORMING APPARATUS, PATTERN POSITION DETERMINING METHOD, AND IMAGE FORMING SYSTEM

(75) Inventors: Daisaku Horikawa, Saitama (JP); Mamoru Yorimoto, Kanagawa (JP); Tatsuhiko Okada, Saitama (JP); Makoto Moriwaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 140 days.

This patent is subject to a terminal disclaimer.

(21) Appl. No.: 13/400,740

(22) Filed: Feb. 21, 2012

(65) Prior Publication Data

US 2012/0218340 A1 Aug. 30, 2012

(30) Foreign Application Priority Data

Feb. 24, 2011 (JP) ..... 2011-038743
Dec. 16, 2011 (JP) ..... 2011-276400

(51) Int. Cl.
*B41J 29/393* (2006.01)

(52) U.S. Cl.
USPC ..... 347/19; 347/14; 347/15

(58) Field of Classification Search
USPC ..... 347/5, 9, 14, 19, 15
See application file for complete search history.

(56) References Cited

U.S. PATENT DOCUMENTS

| | | | | |
|---|---|---|---|---|
| 7,384,117 | B2 * | 6/2008 | Shoki et al. | 347/19 |
| 7,992,953 | B2 | 8/2011 | Yorimoto et al. | |
| 8,157,342 | B2 * | 4/2012 | Morino et al. | 347/14 |
| 2011/0063352 | A1 | 3/2011 | Sakurada et al. | |
| 2011/0298854 | A1 | 12/2011 | Sakurada et al. | |

FOREIGN PATENT DOCUMENTS

| | | | |
|---|---|---|---|
| JP | 2001-129980 | A | 5/2001 |
| JP | 2005-148299 | A | 6/2005 |
| JP | 2008-229915 | A | 10/2008 |

OTHER PUBLICATIONS

The English language abstract for U.S. patent publication No. 7,992,953 corresponds to Japanese patent publication No. JP 2008-229915.

* cited by examiner

*Primary Examiner* — Lam S Nguyen
(74) *Attorney, Agent, or Firm* — Harness, Dickey & Pierce, P.L.C.

(57) ABSTRACT

An image forming apparatus is disclosed which reads a test pattern, including a reading unit, a relative movement unit, a second detected data obtaining unit which obtains one or more second detected data sets of a reflected light which is received from a scanning position of a light by a light receiving unit while the reading unit moves relatively with respect to the recording medium before the test pattern is formed, a first detected data obtaining unit which obtains one or more first detected data sets of the reflected light which is received by the light receiving unit when the light moves over the test pattern at generally the same scanning position as the scanning position while the reading unit moves relatively with respect to the recording medium after the test pattern is formed, and a signal correction unit.

11 Claims, 32 Drawing Sheets

LIGHT EMITTING ELEMENT
LIGHT RECEIVING ELEMENT
SHEET MATERIAL

LIGHT EMITTING ELEMENT
LIGHT RECEIVING ELEMENT
SHEET MATERIAL

Vs2
POSITION
7 6 5 4 3 2 1 0

Vs1
POSITION
POINT OF INFLECTION
7 6 5 4 3 2 1 0

Vs1
Vs2
POSITION
7 6 5 4 3 2 1 0

FIXED VALUE
z
POSITION
POINT OF INFLECTION
7 6 5 4 3 2 1 0

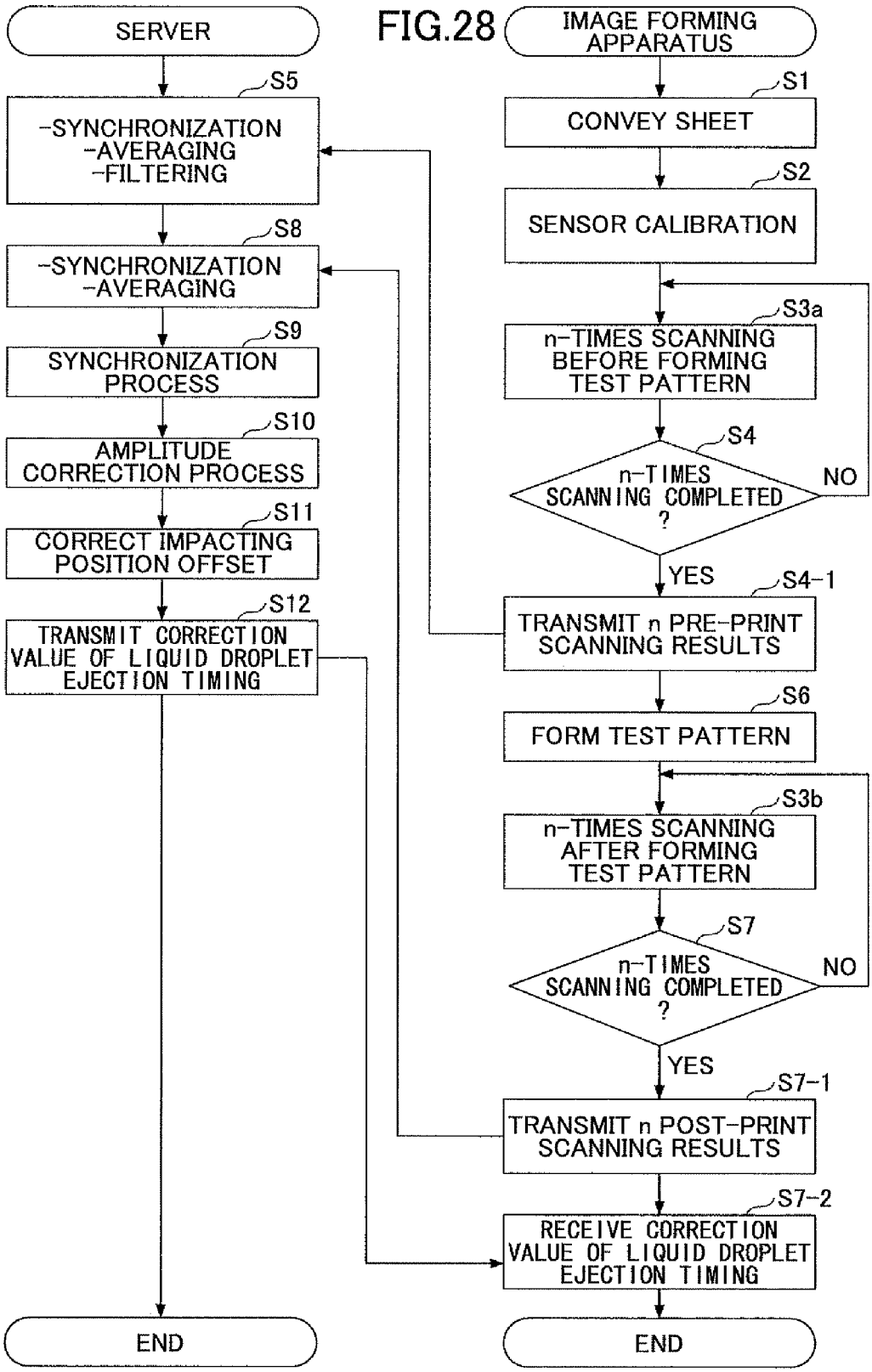
FIG.28
SERVER
IMAGE FORMING APPARATUS
S5
-SYNCHRONIZATION
-AVERAGING
-FILTERING
S8
-SYNCHRONIZATION
-AVERAGING
S9
SYNCHRONIZATION PROCESS
S10
AMPLITUDE CORRECTION PROCESS
S11
CORRECT IMPACTING POSITION OFFSET
S12
TRANSMIT CORRECTION VALUE OF LIQUID DROPLET EJECTION TIMING
END
S1
CONVEY SHEET
S2
SENSOR CALIBRATION
S3a
n-TIMES SCANNING BEFORE FORMING TEST PATTERN
S4
n-TIMES SCANNING COMPLETED ?
NO
YES
S4-1
TRANSMIT n PRE-PRINT SCANNING RESULTS
S6
FORM TEST PATTERN
S3b
n-TIMES SCANNING AFTER FORMING TEST PATTERN
S7
n-TIMES SCANNING COMPLETED ?
NO
YES
S7-1
TRANSMIT n POST-PRINT SCANNING RESULTS
S7-2
RECEIVE CORRECTION VALUE OF LIQUID DROPLET EJECTION TIMING
END

IMAGE FORMING APPARATUS, PATTERN POSITION DETERMINING METHOD, AND IMAGE FORMING SYSTEM

TECHNICAL FIELD

The present invention generally relates to liquid-ejecting image forming apparatuses and more specifically relates to an image forming apparatus which can correct an offset of an impacting position of liquid droplets.

BACKGROUND ART

Image forming apparatuses (below called liquid ejecting image forming apparatuses) are known which eject liquid droplets onto sheet material such as a sheet of paper to form an image. The liquid ejecting image forming apparatuses may generally be divided into a serial-type image forming apparatus and a line-head type image forming apparatus. In the serial-type image forming apparatus, a recording head moves in both main scanning directions perpendicular to a direction of sheet conveying while the sheet conveying is repeated to form an image over the sheet of paper. In the line head-type image forming apparatus with nozzles being aligned in a length which is almost the same length as a maximum width of the sheet of paper, when a timing arrives at which the sheet of paper is conveyed and the liquid droplets are ejected, nozzles within the line head eject the liquid droplets to form the image.

However, it is known that, in the serial-type image forming apparatus, when one ruled line is printed in both directions of an outward path and a return path, an offset of the ruled line is likely to occur between the outward path and the return path. Moreover, it is known that, in the line head-type image forming apparatus, parallel lines are likely to appear in the sheet-conveying direction when there is a nozzle whose position of impacting is constantly offset due to a mounting error, a finishing accuracy of the nozzle, etc.

Therefore, in the liquid-ejecting image forming apparatus, it is often the case that a test pattern for self-adjustment to adjust the position of impacting the liquid droplets is printed on the sheet material, the test pattern is optically read, and an ejection timing is adjusted based on the read results (see Patent document 1, for example.)

Patent document 1 discloses an image forming apparatus which includes a pattern forming unit that forms, on a water-repellent member, a reference pattern including multiple independent liquid droplets and a pattern to be measured that includes multiple independent liquid droplets ejected under an ejection condition different from the reference pattern such that they are aligned in a scanning direction of a recording head; a reading unit including a light emitting unit which irradiates a light onto the respective patterns and a light receiving unit which receives a regular reflected light from the respective patterns; and a correction unit which measures a distance between the respective patterns based on read results of the reading unit for correcting of a liquid droplet ejection timing of the recording head based on the measurement results.

Patent Documents

Patent Document 1 JP2008-229915A

However, the correcting of the liquid droplet ejection timing as disclosed in Patent document 1 has the following problems.

FIG. 1A is an exemplary diagram which schematically describes a light receiving element which reads a test pattern. When a spotlight which is irradiated by an LED scans the test pattern in an arrow direction, a reflected light in accordance with a density of a scanning position of the spotlight is detected at the light receiving element. As is well known, light is absorbed well by a black object, so that it is difficult for the spotlight to be reflected when the test pattern is scanned if a sheet material is white and the test pattern is black. If the reflected light received by the light receiving element is shown in voltage, a voltage when the spotlight overlaps the test pattern is substantially lower than a voltage when somewhere other than the test pattern is scanned as shown.

FIG. 1B is an exemplary exploded view showing a voltage change. A horizontal axis is time or the scanning position of the spotlight. An elongated circle shows a region at which the voltage sharply changes. It is inferred that an edge of the test pattern is within the region, so it is determined, for example, that a centroid of the spotlight scans the edge of the test pattern when a value of the voltage shows a median of a local maximum and a local minimum. Therefore, when the voltage value represents the median of voltage amplitudes, for example, the image forming apparatus may determine that there is the edge position of the test pattern at the scanning position and specify a position of the test pattern.

However, there is a problem that, when a sheet material is a material with a low reflectance (or a high transmittance), such as a tracing paper, it is difficult for a detected voltage of the light receiving element to be stable, so that the edge position of the test pattern may not be specified accurately. In other words, for the sheet material with the low reflectance, the amplitude of the voltage value becomes small, or an amplification of sensor sensitivity or a variation in transmittance of the sheet material leads to a large variation in the voltage value, leading to instability. When the amplitude of the detected voltage of the light receiving element becomes small or unstable a median of the amplitude of the voltage no longer becomes so limited as to indicate the edge position of the test pattern, so that an accuracy of adjusting an ejection timing of a liquid droplet decreases.

DISCLOSURE OF THE INVENTION

In light of the problems as described above, an object of embodiments of the present invention is to provide an image forming apparatus which adjusts an ejection timing of liquid droplets, which image forming apparatus can suppress an effect received due to characteristics of the sheet material to accurately specify a position of a test pattern.

According to an embodiment of the present invention, an image forming apparatus is provided which reads a test pattern formed by ejecting liquid droplets onto a recording medium to adjust an ejection timing of the liquid droplets, including: a reading unit including a light emitting unit which irradiates a light onto the recording medium, and a light receiving unit which receives a reflected light from the recording medium, a relative movement unit which relatively moves the recording medium or the reading unit at a constant speed, a second detected data obtaining unit which obtains one or more second detected data sets of the reflected light which is received from a scanning position of the light by the light receiving unit while the reading unit moves relatively with respect to the recording medium before the test pattern is formed; a first detected data obtaining unit which obtains one or more first detected data sets of the reflected light which is received by the light receiving unit when the light moves over the test pattern at generally the same scanning position as the scanning position while the reading unit moves relatively with respect to the recording medium after the test pattern is formed; and a signal correction unit which calculates a proportion of the first detected data sets relative to the second detected data sets to align a local maximum value of the first detected data sets such that it is generally constant.

Embodiments of the present invention make it possible to provide an image forming apparatus which adjusts an ejection timing of liquid droplets, which image forming apparatus can suppress an effect received due to characteristics of a sheet material to accurately specify a position of a test pattern.

BRIEF DESCRIPTION OF THE DRAWINGS

Other objects, features, and advantages of the present invention will become more apparent from the following detailed descriptions when read in conjunction with the accompanying drawings, in which:

FIG. 28 is a flowchart which shows an operating procedure of the image forming system.

BEST MODE FOR CARRYING OUT THE INVENTION

A description is given below with regard to embodiments of the present invention with reference to the drawings.

Embodiment 1

One feature of the present embodiment is performing an amplitude correction process which adjusts an amplitude relative to a detected voltage which is detected by a light receiving element.

Figure 1A:
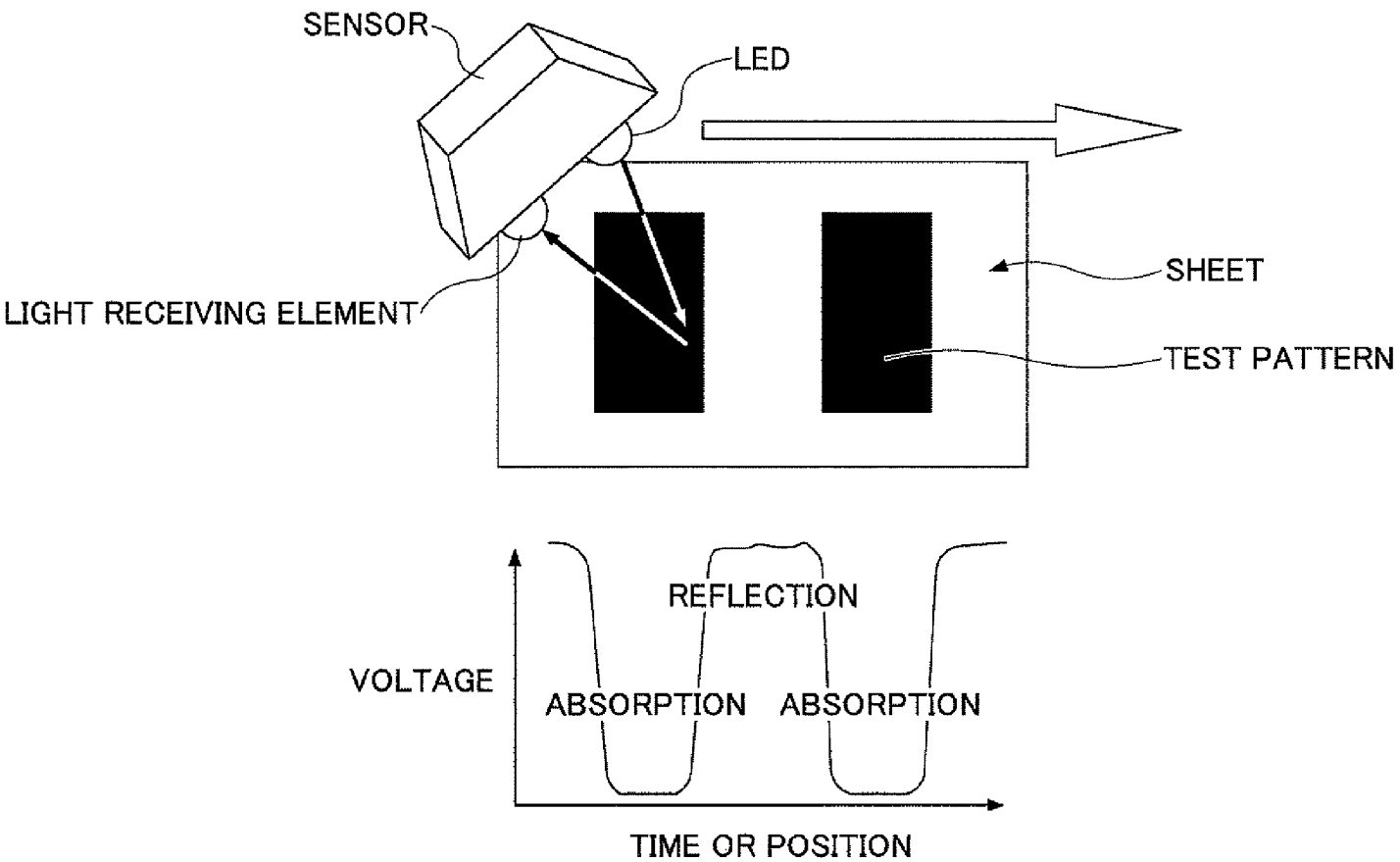
FIGS. 1A and 1B are exemplary diagrams which schematically describe a light receiving element which reads a test pattern.
Figure 1B:
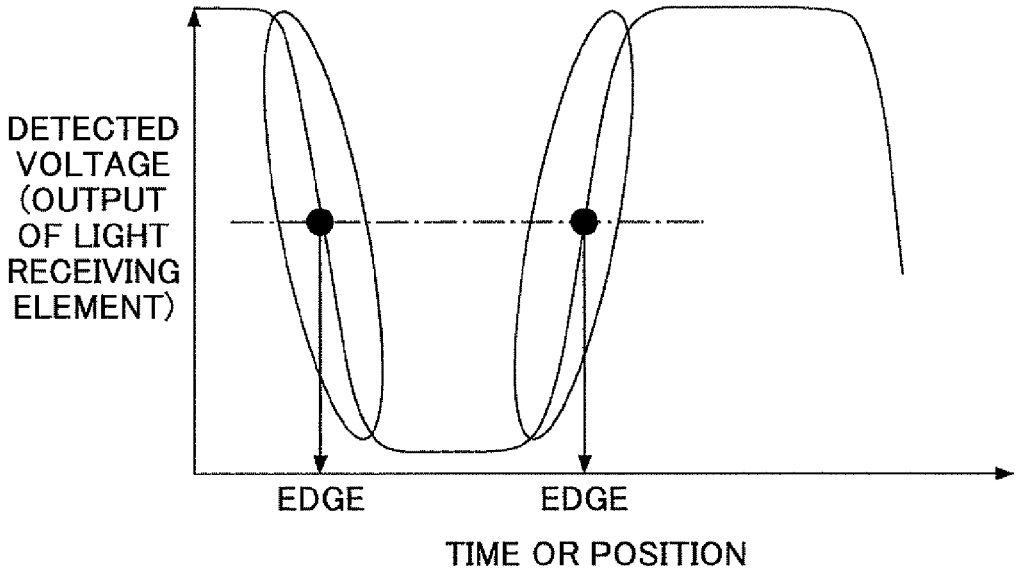
Figures 2A, 2B, 2C, 2D, 2E, 2F:
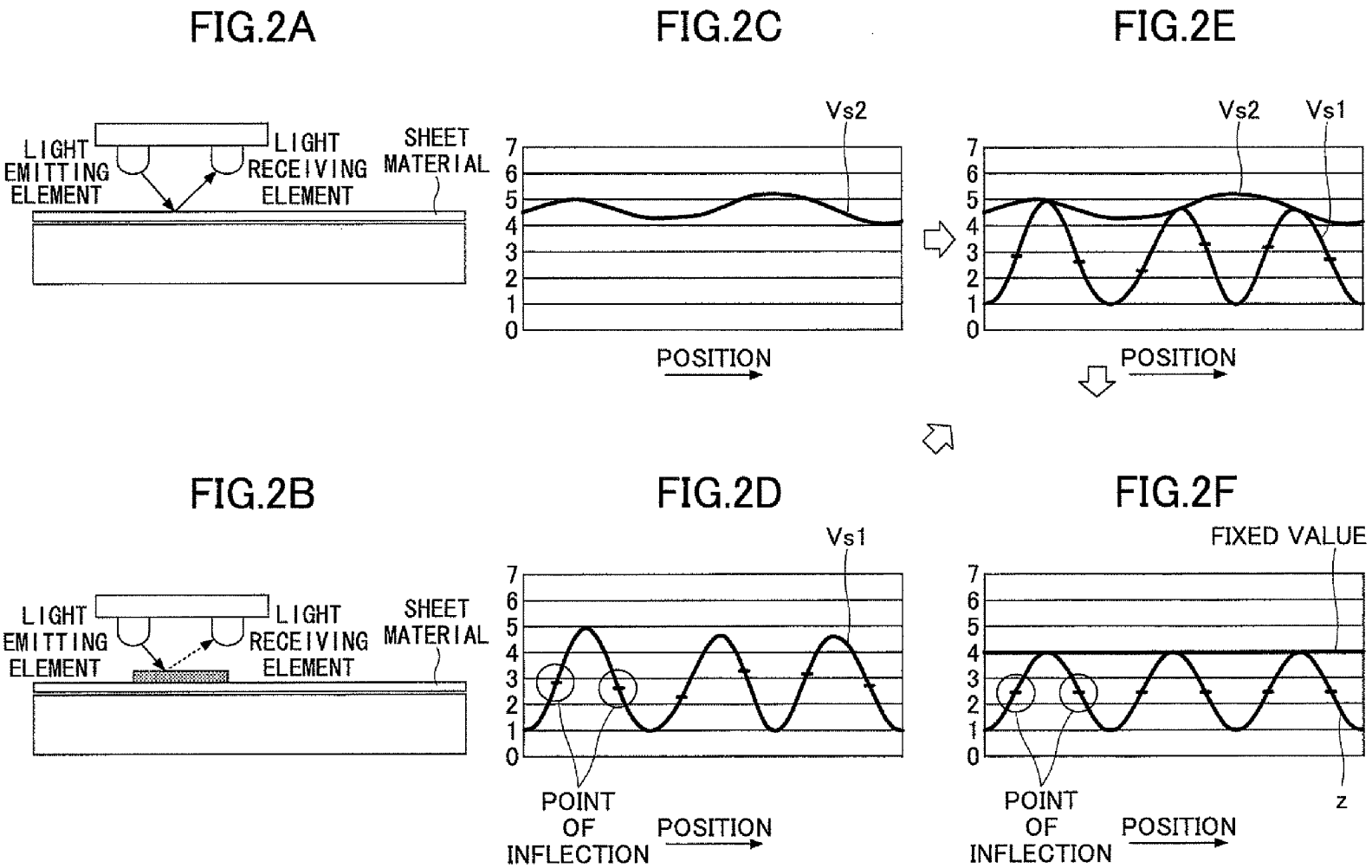
FIGS. 2A, 2B, 2C, 2D, 2E, and 2F are exemplary diagrams which describe an amplitude correction process.

FIGS. 2A and 2B are exemplary diagrams which schematically illustrate a light emitting element, a light receiving element, and a sheet material. FIG. 2C shows an example of a detected voltage Vs2 of a sheet material with a low reflectance, such as a tracing paper, etc., while FIG. 2D shows an example of a detected voltage Vs1 of a tracing paper on which a test pattern is formed. As shown in FIG. 2C, when a spotlight scans a sheet material with a low reflectance (a high transmittance) as shown in FIG. 2C, the detected voltage becomes unstable. Moreover, when the spotlight scans the sheet material on which the test pattern is formed, the detected voltage is unstable even though the instablity is not likely to be noticeable due to an occurrence of a local maximum value and a local minimum value.

As described below, the image forming apparatus uses detected voltage data (which refer to digital values of the detected voltage; the detected voltage and the detected voltage data are used without any particular distinctions) around a point of inflection of the detected voltage (a short horizontal line shown on the detected voltage) to determine an edge position of a line (below the test pattern and line are described without any exact distinctions) which makes up the test pattern. However, as the position of the point of inflection is not stable, an accuracy of detecting the edge position of the test pattern decreases. Then, the image forming apparatus performs a correction which suppresses a variation of the detected voltage in FIG. 2D.

FIG. 2E shows an example of a graph in which Vs1 and Vs2 are overlapped. As the Vs1 and the Vs2 become detected voltage data for the same position as a result of a below-described synchronization process, Vs1 and Vs2 become almost equal when the spotlight scans a location without the test pattern, while when it scans a location with the test pattern Vs1 takes a local minimum value. This means that Vs1 is a detected voltage due to a reflected light which is detected and which could not be completely absorbed by the test pattern with Vs2 as a reference (a maximum) at a certain position.

In other words, even when a variation caused by a transmittance of the sheet material differs from position to position, Vs1 becomes large at a position in which the variation increases the detected voltage, and Vs1 becomes small at a position in which the variation decreases the detected voltage.

In other words, this shows that a variation caused by a position included in Vs1 can be properly corrected with a proportional correction called "Vs1/Vs2". This ratio takes a value from 0 (when Vs1 is zero; in practice, the reflected light is never completely absorbed by the test pattern, so that it does not become zero) to 1 (when Vs1=Vs2). As a result of this "Vs1/Vs2" process the local maximum values of the ratio are almost aligned to 1, so that the position of the point of inflection also becomes stable as a necessity. Multiplying the ratio by a fixed factor yields a detected voltage with a stable (generally constant) amplitude.

Therefore, an appropriate fixed value may be determined as an amplitude to obtain a detected voltage with a constant amplitude with "a fixed value×x'/y'". Based on the above, when the detected voltage is assumed to be z, the detected voltage z after the correction may be denoted as $$z = \text{Fixed value} \times (Vs1/Vs2).$$

FIG. 2F shows one example of data z to be operated on. The detected voltage with a stable amplitude (below-described data z to be operated on) is obtained with a ratio between Vs1 and Vs2 being reflected on the fixed value. This process of "Vs1/Vs2" or a process of "a fixed value×x'/y'" is an amplitude correction process.

According to the image forming apparatus according to the present embodiment, an amplitude correction process makes it possible to accurately specify an edge position of a test pattern even when amplitude of detected voltage data becomes unstable due to characteristics of a sheet material.

(Configuration)

Figure 3:
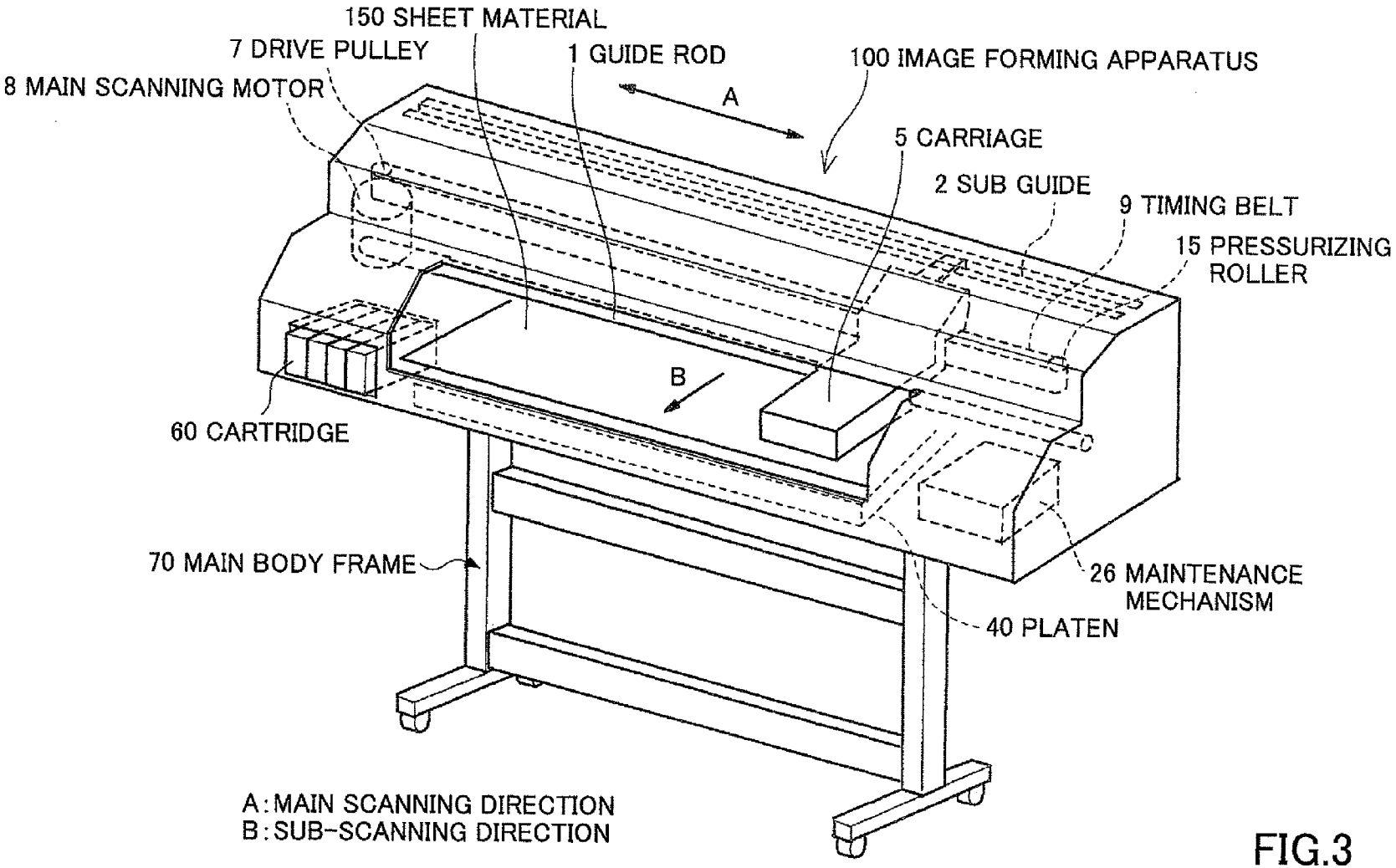
FIG. 3 is an exemplary schematic perspective view of a serial-type image forming apparatus.

FIG. 3 illustrates an exemplary schematic perspective view of a serial-type image forming apparatus 100. The image forming apparatus 100 is supported by a main body frame 70. A guide rod 1 and a sub guide 2 are bridged across in a longitudinal direction of the image forming apparatus 100, and a carriage 5 is held in arrow A directions (main scanning directions) by the guide rod 1 and the sub guide 2 such that it can move in both directions.

Moreover, an endless belt-shaped timing belt 9 is stretched by a drive pulley 7 and a pressurizing roller 15 in the main scanning directions, and a part of the timing belt 9 is fixed to the carriage 5. Moreover, the drive pulley 7 is rotationally driven by a main scanning motor 8, thereby moving the timing belt 9 in the main scanning directions and also moving the carriage 5 in both directions. With the tension being applied to the timing belt 9 by the pressurizing roller 15, the timing belt 9 may drive the carriage 5 without slack.

Moreover, the image forming apparatus 100 includes a cartridge 60 which supplies ink and a maintenance mechanism 26 which maintains and cleans a recording head.

A sheet material 150 is intermittently conveyed on a platen 40 on the lower side of the carriage 5 in an arrow B direction (a sub-scanning direction) by a roller (not shown). The sheet material 150 may be a recording medium onto which liquid droplets can be attached, such as an electronic substrate, a film, a glossy paper, a plain paper such as a sheet of paper, etc. For each conveying position of the sheet material 150, the carriage 5 moves in the main scanning directions and the recording head mounted on the carriage 5 ejects the liquid droplets. When the ejecting is finished, the sheet material 150 is again conveyed and the carriage 5 moves in the main scanning directions to eject the liquid droplets. The above process is repeated to form an image on the whole face of the sheet material 150.

Figure 4:
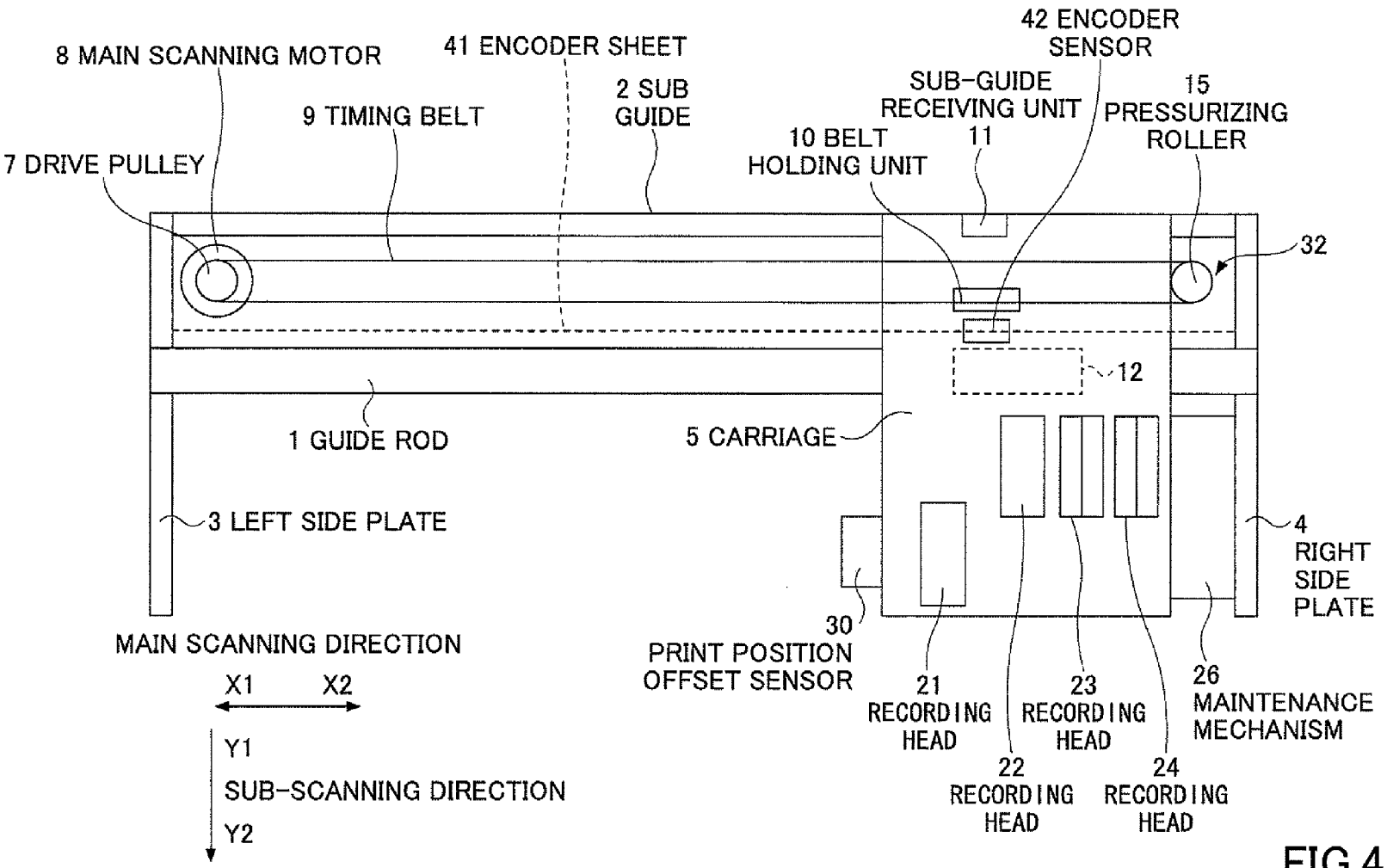
FIG. 4 is an exemplary diagram which describes in more detail an operation of a carriage.

FIG. 4 is an exemplary diagram which describes in more detail operations of the carriage 5. The above-described guide rod 1 and the sub rod 2 are bridged across a left side plate 3 and a right side plate 4, and the carriage 5 is held by bearings 12 and a sub-guide receiving unit 11 to be able to freely slide on the guide rod 1 and the sub-guide 2, so that it can move in arrows X1 and X2 directions (main scanning directions).

On the carriage 5 are mounted recording heads 21 and 22 which eject black (K) liquid droplets, and recording heads 23 and 24 which eject ink droplets of cyan (C), magenta (M), and yellow (Y). The recording head 21 is arranged since the black is often used, but it may be omitted.

As the recording heads 21-24, a so-called piezo-type recording head in which piezoelectric elements are used as pressure generating units (an actuator unit) each of which pressurizes ink within an ink flow path (a pressure generating chamber) by deforming a vibrating plate which forms a wall face of the ink flow path to change a volume within the ink flow path to cause an ink droplet to be ejected; a so-called thermal-type recording head in which ink droplets are ejected with pressure due to using a heat generating resistive body to heat ink within each of the ink channel paths to generate a foam; or an electrostatic-type recording head in which sets of a vibrating plate and an electrode, which form a wall face of the ink flow path, are arranged so that they oppose each other; and the vibrating plate is deformed due to an electrostatic force generated between the vibrating plate and the electrode, etc., to change a volume within the ink flow path to cause an ink droplet to be ejected.

A main scanning mechanism 32 which moves the carriage 5 to scan includes the main scanning motor 8 which is arranged on one side in the main scanning directions, the drive pulley 7 which is rotationally driven by the main scanning motor 8, the pressurizing roller 15 which is arranged on the other side in the main scanning directions, and the timing belt 9 which is bridged across the drive pulley 7 and the pressurizing roller 15. The pressurizing roller 15 has a tension force acting outward (in a direction away from the drive pulley 7) caused by a tension spring (not shown).

The timing belt 9 has a portion fixed to and held by a belt holding unit 10 which is provided on a back face side of the carriage 5, so that it pulls the carriage 5 in the main scanning directions with an endless movement of the timing belt 9.

Moreover, with an encoder sheet 41 arranged such that it follows the main scanning directions of the carriage 5, an encoder sensor 42 the carriage 5 is provided with may read slits of the encoder sheet 42 to detect a position of the carriage 5 in the main scanning directions. When the carriage 5 exists in a recording area out of a main scanning area, the sheet material 150 is intermittently conveyed in an arrow-indicated Y1 to Y2 direction (a sub-scanning direction) which is orthogonal to the main scanning directions of the carriage 5 by a paper-conveying mechanism (not shown).

The above-described image forming apparatus 100 according to the present embodiment may drive the recording heads 21-24 according to image information to eject liquid droplets while moving the carriage 5 in the main scanning directions and intermittently conveying the sheet material 150 to form a required image on the sheet material 150.

On one side face of the carriage 5 is mounted a print position offset sensor 30 for detecting an offset of an impacting position (reading the test pattern). The print position offset sensor 30 reads a test pattern for detecting the impacting position that is formed on the sheet material 150 with a light receiving element which includes a reflective-type photosensor and a light-emitting element such as an LED, etc.

As the print position offset sensor 30 is for the recording head 21, a liquid droplet ejection timing of the recording heads 22-24 is adjusted, so it is preferable to mount a separate print position offset sensor 30 parallel to the recording heads 22-24. Moreover, the carriage 5 may have mounted a mechanism which slides the print position offset sensor 30 such that it becomes in parallel with the recording heads 22-24 to adjust a liquid droplet ejection timing of the recording heads 22-24 with one print position offset sensor 30. Alternatively, the liquid droplet ejection timing of the recording heads 22-24 may be adjusted with the one print position offset sensor 30 even when the image forming apparatus 100 conveys the sheet material 150 in a reverse direction.

Figure 5:
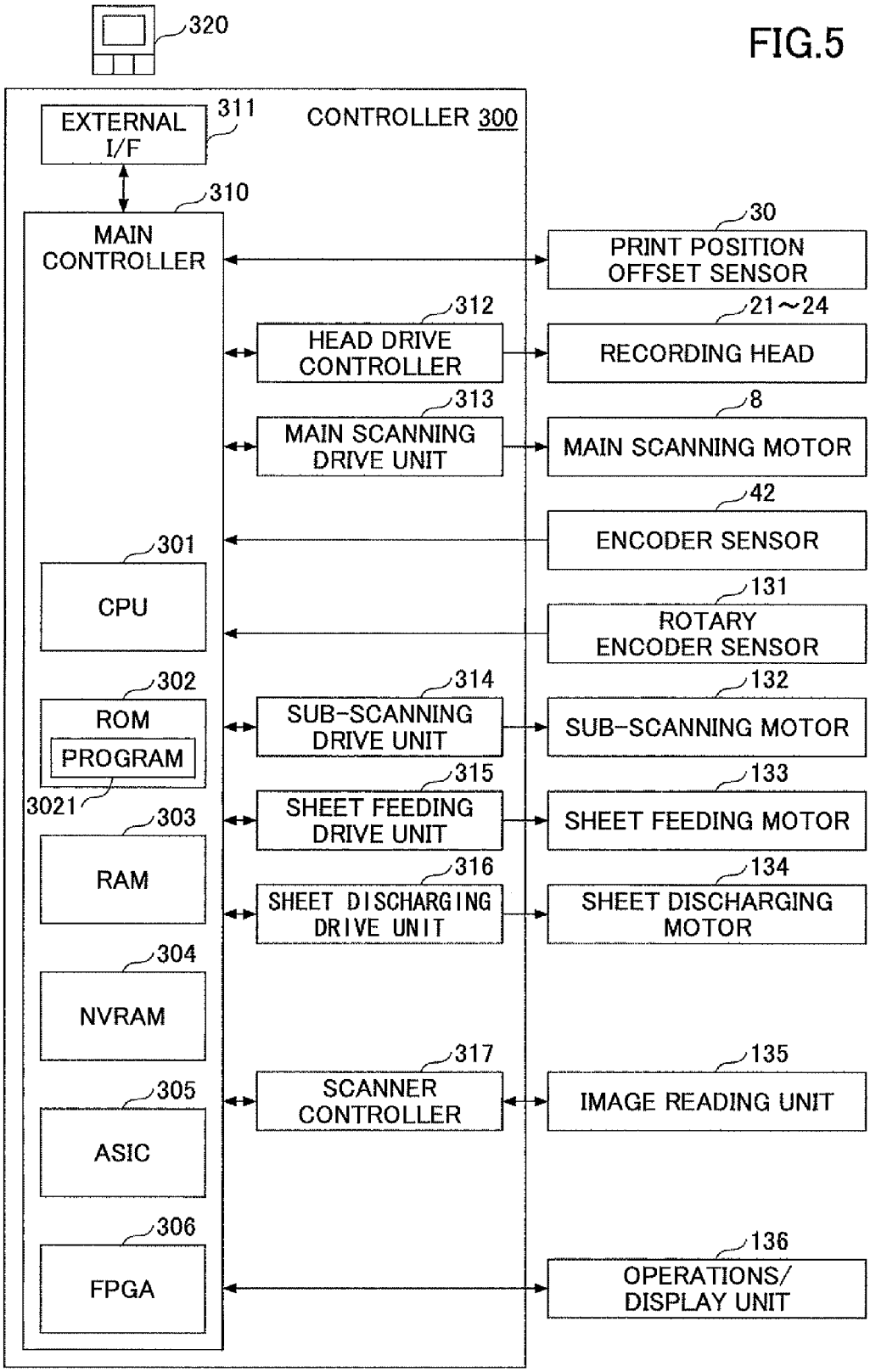
FIG. 5 is an exemplary block diagram of a controller of an image forming apparatus.

FIG. 5 is an exemplary block diagram of a controller 300 of the image forming apparatus 100. The controller 300 includes a main controller 310 and an external I/F 311. The main controller 310 includes a CPU 301, a ROM 302, a RAM 303, a NVRAM 304, an ASIC 305, and a FPGA (Field programmable gate array) 306. The CPU 301 executes a program 3021 which is stored in the ROM 302 to control the whole of the image forming apparatus 100. In the ROM 302 is stored, besides the program 3021, fixed data such as a parameter for control, an initial value, etc. The RAM 303 is a working memory which temporarily stores a program, image data, etc., while the NVRAM 304 is a non-volatile memory for storing data such as a setting condition, etc., even during a time a power supply of the apparatus is being blocked. The ASIC 305 performs various signal processing, sorting, etc., on the image data and controls various engines. The FPGA 306 processes input and output signals for controlling the whole apparatus.

The main controller 310 manages control with respect to forming a test pattern, detecting the test pattern, adjusting (correcting) an impacting position, etc., as well as control of the whole apparatus. As described below, in the present embodiment, while mainly the CPU 301 executes the program 3021 stored in the ROM 302 to detect an edge position, some or all thereof may be performed by an LSI, such as the FPGA 306, the ASIC 305, etc.

The external I/F 311, which is a bus or a bridge for connecting to an IEEE 1394 port, a USB, and a communications apparatus for communicating with other equipment units connected to a network, sends data from outside to the main controller 310. Moreover, the external I/F 311 externally outputs data generated by the main controller 310. To the external I/F 311 can be connected a detachable storage medium 320, and the program 3021 may be stored in the recording medium 320 or distributed via an external communications apparatus.

Moreover, the controller 300 includes a head drive controller 312, a main scanning drive unit 313, a sub-scanning drive unit 314, a sheet feeding drive unit 315, a sheet discharging drive unit 316, and a scanner controller 317. The head drive controller 312 controls for each of the recording heads 21-24 whether an ejection is made, and a liquid droplet ejection timing and an ejection amount in case the ejection is made. The head drive controller 312, which includes an ASIC (a head driver) for generating, aligning, and converting head data for driving and controlling the recording heads 21-24, generates, based on printing data (dot data to which a dithering process, etc., is applied), a drive signal which indicates the presence/absence of the liquid droplets and sizes of the liquid droplets to supply the generated drive signal to the recording heads 21-24. With the recording heads 21-24 including a switch for each nozzle and being turned on and off based on the drive signal, the recording heads 21-23 eject liquid droplets of a specified size to impact at positions of the sheet material 150 specified by the printing data. The head driver of the head drive controller 312 may be provided on the recording heads 21-24 side or the head drive controller 312 and the recording heads 21-24 may be integrated. The configuration shown is an example.

The main scanning drive unit (a motor driver) 313 drives the main scanning motor 8 which moves the carriage 5 to scan. To the main controller 310 is connected an encoder sensor 42 which detects the above-described carriage position, and the main controller 310 detects a position in the main scanning directions of the carriage 5 based on this output signal. Then, the main scanning motor 8 is driven and controlled via the main scanning drive unit 313 to move the carriage 5 in both of the main scanning directions.

The sub-scanning drive unit (motor driver) 314 drives a sub-scanning motor 132 for conveying a sheet of paper. To the main controller 310 is input an output signal (a pulse) from a rotary encoder sensor 131 which detects an amount of movement in the sub-scanning direction, and the main controller 310, based on this output signal, detects an amount of sheet conveying, and drives and controls the sub-scanning motor 132 via the sub-scanning drive unit 314 to convey the sheet material via a conveying roller (not shown).

The sheet feeding drive unit 315 drives a sheet feeding motor 133 which feeds the sheet material from a sheet feeding tray. The sheet discharging drive unit 316 drives a sheet discharging motor 134 which drives a roller for discharging a printed sheet material 150 onto a platen. The sheet discharging drive unit 316 may be replaced with the sub-scanning drive unit 314.

The scanner controller 317 controls an image reading unit 135. The image reading unit 135 optically reads a manuscript and generates image data.

Moreover, to the main controller 310 is connected an operations/display unit 136 which includes various displays and various keys such as ten keys, a print start key, etc. The main controller 310 accepts a key input which is operated by a user via the operations/display unit 136, displays a menu, etc.

In addition, although not shown, it may also include a recovery drive unit for driving a maintenance and recovery motor which drives a maintenance mechanism 26, a solenoid drive unit (driver) which drives various solenoids (SOLs), and a clutch drive unit which drives electromagnetic cracks, etc. Moreover, a detected signal of various other sensors (not shown) is also input to the main controller 310, but illustrations thereof are omitted.

The main controller 310 performs a process of forming the test pattern on the sheet material and performs light emission drive control on the formed test pattern, which causes a light emitting element of the print position offset sensor 30 mounted on the carriage 5 to emit a light. Then, an output signal of the light receiving element is obtained, the reflected light of the test pattern is electrically read, an impacting position offset amount is detected from the read results, and, furthermore, a control process is performed in which a liquid droplet ejection timing of recording heads 21-24 is corrected based on the impacting position offset amount such that there would be no impacting position offset.

(Correction of Impacting Position Offset)

Figure 6:
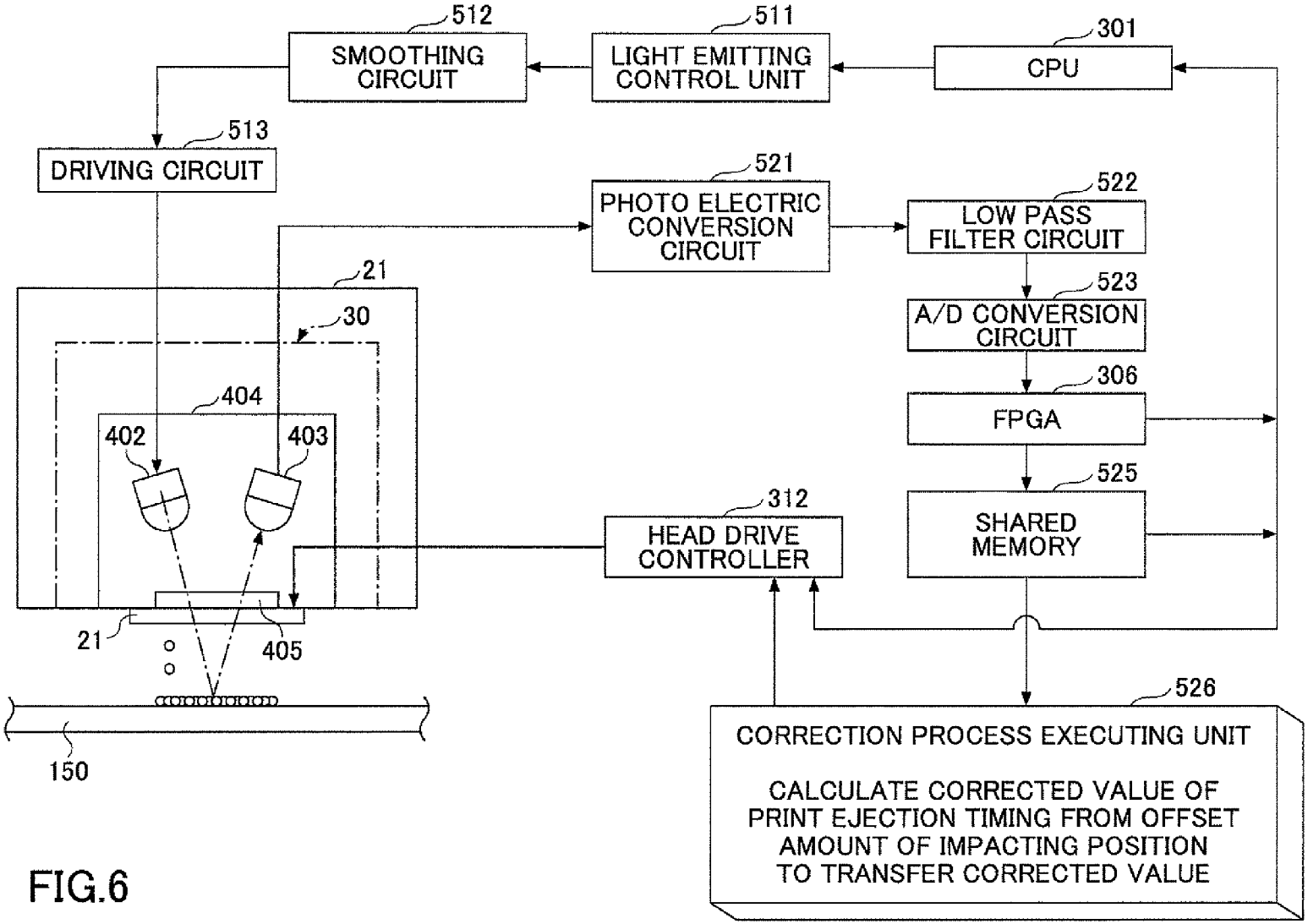
FIG. 6 is an exemplary diagram which schematically shows a configuration for a print position offset sensor to detect an edge of the test pattern.

FIG. 6 is an exemplary diagram which schematically shows a configuration for the print position offset sensor 30 to detect an edge position of a test pattern. FIG. 6 shows the recording head 21 and the print position offset sensor 30 in FIG. 4 that are viewed from the right side face plate 4.

The print position offset sensor 30 includes a light emitting element 402 and a light receiving element 403 which are aligned in a direction orthogonal to the main scanning directions. Arrangements of the light emitting element 402 and the light receiving element 403 may be reversed. The light emitting element 402 projects a below-described spotlight onto a test pattern, so that the light receiving element 403 receives a light reflected onto the sheet material 150, a reflected light from a platen 40, other scattered lights, etc. The light emitting element 402 and the light receiving element 403 are fixed to inside a housing and a face which opposes the platen 40 of the print position offset sensor 30 is shielded from outside with a lens 405. In this way, the print position offset sensor 30 is packaged, so that it may be distributed as a unit.

Within the print position offset sensor 30, the light emitting element 402 and the light receiving element 403 are arranged in a direction which is orthogonal to a scanning direction of the carriage 5 (are arranged in a direction parallel to the sub-scanning direction). This makes it possible to reduce an impact, on detected results, of a moving speed change of the carriage 5.

For the light emitting element 402, an LED may be adopted, for example; however, the light emitting element 402 may be a light source (e.g., a laser, various lamps) which can project any visible light. The visible light is used in order to expect that the spotlight be absorbed by the test pattern. While a wavelength of the light emitting element 402 is fixed, multiple print position offset sensors 30 can be mounted with the light emitting elements 402 of different wavelengths.

Moreover, a diameter of a spot formed by the light emitting element 402 is in the order of mms for using an inexpensive lens without using a high accuracy lens. For this spot diameter, which is related to accuracy of detecting an edge of a test pattern, even when it is in the order of mms, an edge position may be detected with sufficiently high accuracy as long as the edge position is determined according to the present embodiment. The spot diameter can also be made smaller.

When a certain timing is reached, the CPU 301 starts an impacting position offset correction. The above-mentioned timing includes, for example, a timing at which an impacting position offset correction is instructed from the operations/display unit 136 by the user; a timing at which a material is determined by the CPU 301 to be made of a certain sheet material 150 as an intensity of a light reflected at the time the light emitting element 402 emits a light before ink is ejected is no more than a predetermined value; a timing at which either a temperature or a humidity which are stored when an impacting position offset correction is performed is offset by at least a threshold value, a periodic (daily, weekly, monthly, etc.) timing, etc.

An impacting position offset correction according to the present embodiment is a two stage process including a process before a test pattern is formed and a process after the test pattern is formed. However, the main difference is whether the test pattern is formed, so that a case in which the test pattern is formed is described here.

The CPU 301 instructs the main scanning controller 313 to move the carriage 5 in both directions and instructs the head drive controller 312 to eject liquid droplets with a predetermined test pattern as printing data. While the main scanning controller 313 moves the carriage 5 in both of the main scanning directions relative to the sheet material 150, the head drive controller 312 causes liquid droplets to be ejected from the recording head 21 to form a test pattern which includes at least two independent lines.

Moreover, the CPU 301 performs control for reading, by the print position offset sensor 30, the test pattern formed on the sheet material 150. More specifically, a PWM value for driving the light emitting element 402 of the print position offset sensor 30 is set in a light-emitting controller 511 by the CPU 301, and an output of the light-emitting controller 511 is smoothed at a smoothing circuit 512, so that the smoothed result is provided to a driving circuit 513. The driving circuit 513 drives the light emitting element 402 to emit a light, so that a spotlight is irradiated from the light emitting element 402 onto a test pattern of the sheet material 150. The light emitting controller 511, the smoothing circuit 512, the driving circuit 513, a photoelectric conversion circuit 521, a low-pass filter 522, an A/D conversion circuit 523, and a correction process executing unit 526 are installed in the main controller 310 or the controller 300. The shared memory 525 is the RAM 303, for example.

A spotlight from the light emitting element 402 is irradiated onto a test pattern on a sheet material, so that a reflected light which is reflected from the test pattern is incident on the light receiving element 403. The light receiving element 403 outputs an intensity signal of the reflected light to the photoelectric conversion circuit 521. More specifically, the photoelectric conversion circuit 521 photoelectrically converts the intensity signal so as to output the photoelectrically converted signal to the low-pass filter circuit 522. The low-pass filter circuit 522 removes a high-frequency noise portion and then outputs the photoelectrically converted signal to the A/D conversion circuit 523. The A/D conversion circuit 523 A/D converts the photoelectrically converted signal and outputs the A/D converted signal to the signal processing circuit (FPGA) 306. The signal processing circuit (FPGA) 306 stores the detected voltage data sets which are digital values of the A/D converted detected voltage into the shared memory 525.

The correction process executing unit 526 reads the detected voltage data sets stored in the shared memory 525, performs an impacting position offset correction, and sets them in the head drive controller 312. In other words, the correction process executing unit 526 detects an edge position of a test pattern to compare with an optimal distance between two lines to calculate an impacting position offset amount.

The correction process executing unit 526 calculates a correction value of a liquid droplet ejection timing at which the recording head 21 is driven such that the impacting position offset is removed to set the calculated correction value of the liquid droplet ejection timing in the head drive controller 312. In this way, when driving the recording head 21, the head drive controller 312 corrects the liquid droplet ejection timing based on the correction value to drive the recording head 21, making it possible to reduce the impacting position offset of the liquid droplets.

Figure 7:
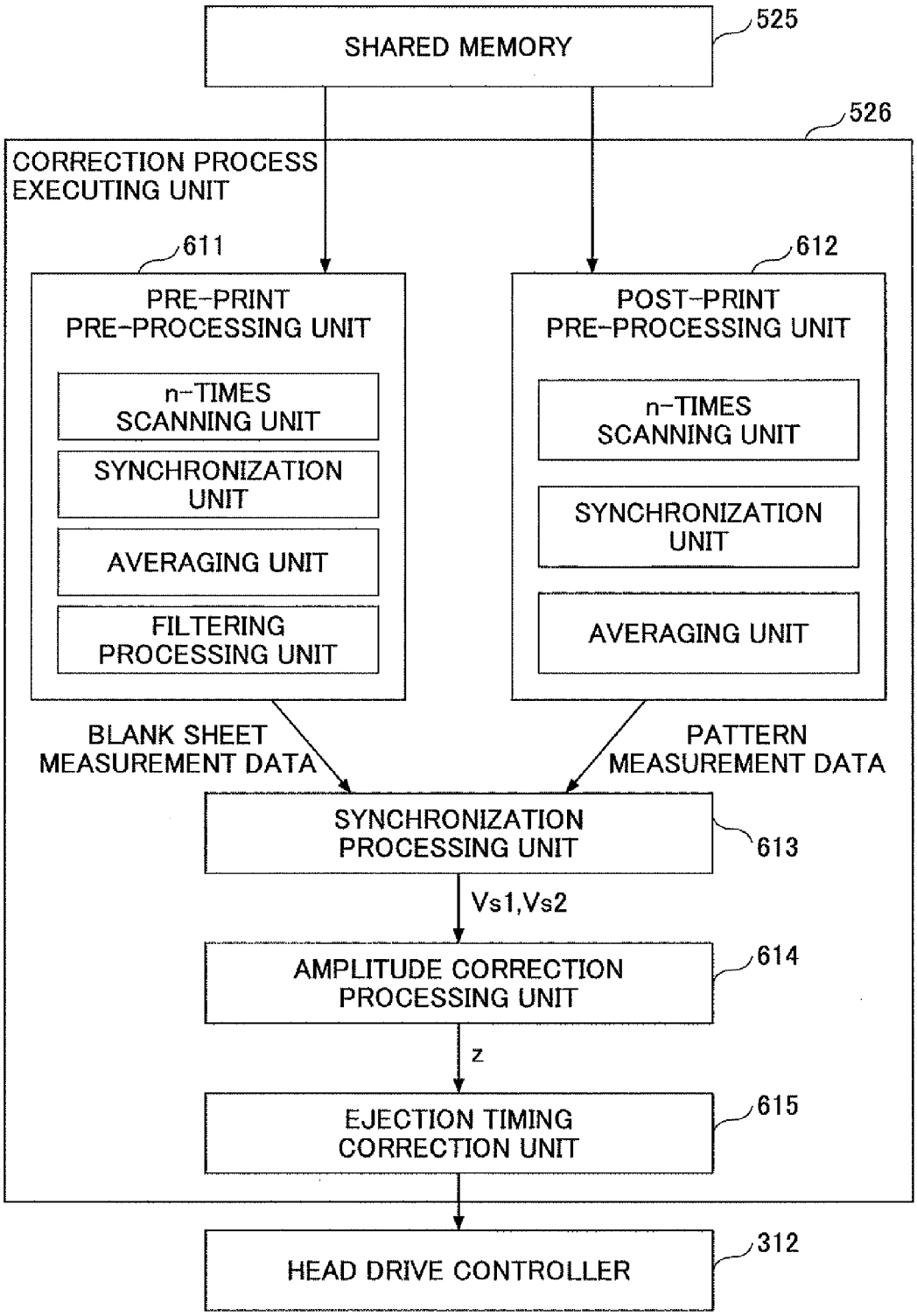
FIG. 7 is an exemplary functional block diagram of a correction process executing unit.

FIG. 7 is an exemplary functional block diagram of the correction process executing unit 526. The correction process executing unit 526 includes a pre-print pre-processing unit 611, a post-print pre-processing unit 612, a synchronization processing unit 613, an amplitude correction processing unit 614, and an ejection timing correction unit 615. The pre-print pre-processing unit 611 applies pre-processing to detected voltage data before the test pattern is formed, while the post-print pre-processing unit 612 applies pre-processing to detected voltage data after the test pattern is formed. The synchronization processing unit 613 synchronizes (aligns) the detected voltage data before the test pattern is formed and the detected voltage data after the test pattern is formed. The amplitude correction processing unit 614 performs an amplitude correction process to generate data z to be operated on, which data are for computing an edge position. The ejection timing correction unit 615 corrects the liquid droplet ejection timing based on an impacting position offset amount which is determined from the edge position of the test pattern. These processes will be described below in detail.

(Spotlight Position and Edge Position)

Next, a relationship between a spotlight and an edge position is described using FIGS. 8, 9A, 9B, 9C, and 9D.

Figure 8:
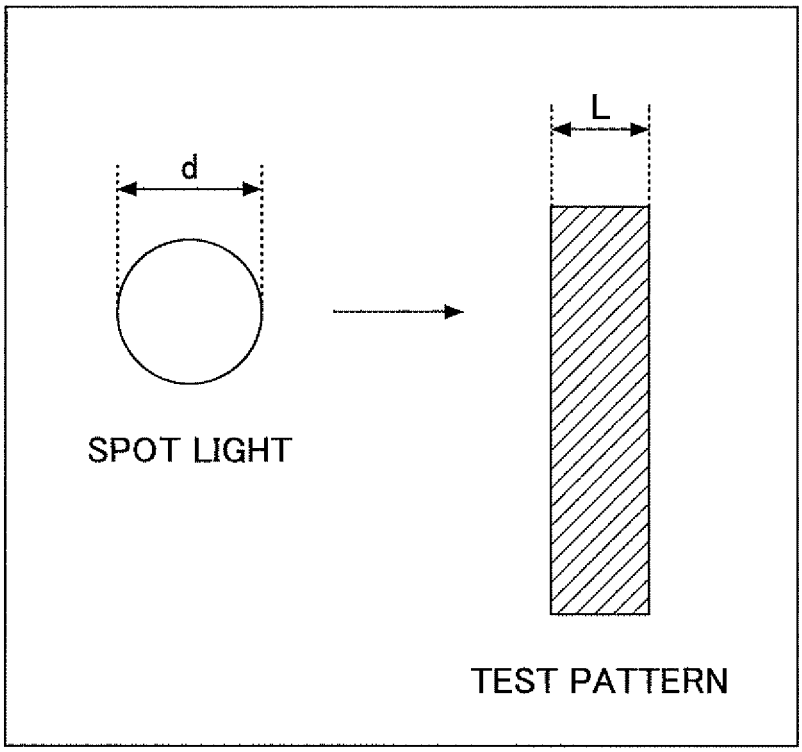
FIG. 8 is a diagram illustrating an example of a spotlight and the test pattern.

FIG. 8. is a diagram illustrating an example of a spotlight and a test pattern. The spotlight moves such that it crosses multiple lines (one line shown) which make up a test pattern at a constant speed (equal speeds); however, the speed of the crossing may be arranged to be variable in the image forming apparatus according to the present invention. As a sheet material such as a sheet of paper moves in a longer direction of the line through sheet feeding, the spotlight moves such that it crosses the line obliquely; however, even when the sheet material stops, a method of specifying the edge position is the same. With the sheet material and the spotlight of a common wavelength, it can be said that a reflected light of the spotlight decreases the larger an overlapping area of the test pattern becomes.

In FIGS. 8, 9A, 9B, 9C, and 9D, it is assumed that Spot diameter d=Line width L of a test pattern. In actuality, while a spotlight becomes somewhat elliptical, it has a long axis parallel to the test pattern, so that a shape of the spotlight has almost no impact on an accuracy of the edge position.

Figure 9A:
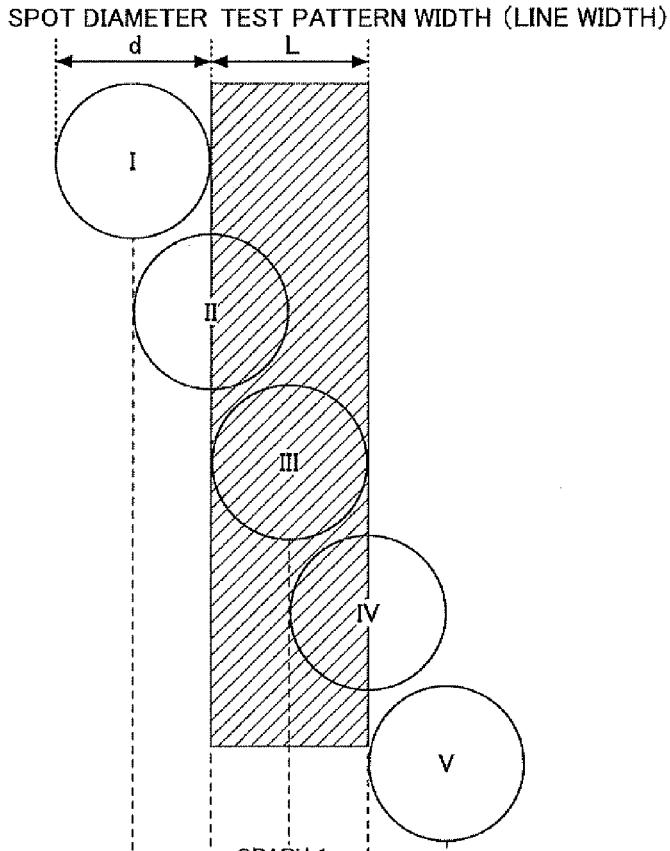
FIGS. 9A, 9B, 9C, and 9D are diagrams illustrating an example of the spotlight and the test pattern.

FIGS. 9A, 9B, 9C, and 9D are exemplary diagrams which describe an outline for specifying the edge position of the present embodiment. Letters I-V in FIG. 9A show a time lapse, where an elapsed time is longer for the lower spotlight:

Time I: The spotlight and the test pattern do not overlap;

Time II: A half of the spotlight overlaps the test pattern. At this moment, a rate of decrease of the reflected light becomes the largest (an overlapping area positively changes most in a unit time);

Time III: The whole of the spotlight overlaps the test pattern. At this moment, an intensity of the reflected light becomes the smallest; and Time IV: A half of the spotlight overlaps the test pattern. At this moment, a rate of increase of the reflected light becomes the largest (the overlapping area negatively changes most in the unit time.)

A centroid of the spotlight matches the edge position of the line of the test pattern at the Times II and IV. Therefore, if the fact that the spotlight and the line have relationship of the Times II and IV may be detected from the reflected light, the edge position may be specified accurately.

Figure 9B:
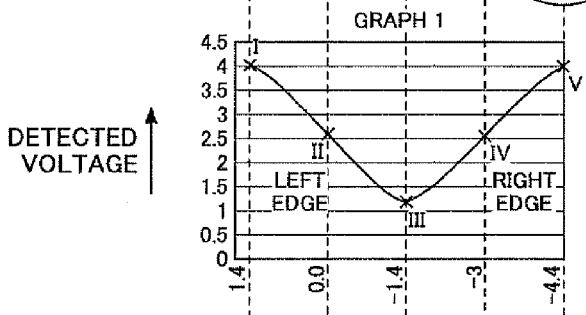
Figure 9C:
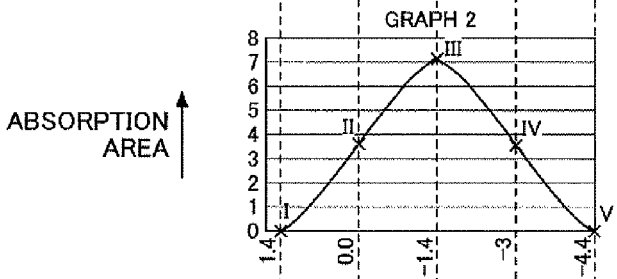
Figure 9D:
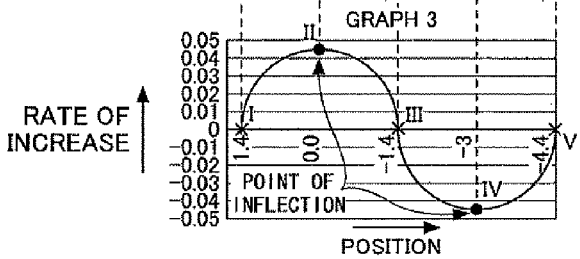

FIG. 9B shows an exemplary detected voltage of a light receiving element, FIG. 9C shows an exemplary absorption area (an overlapping area of the spotlight and the test pattern), and FIG. 9D shows an exemplary rate of increase of the absorption area, which rate of increase is a derivative of the absorption area in FIG. 9C. For FIG. 9D, equivalent information may be obtained even when a derivative of an output waveform of FIG. 9B is taken. Moreover, the absorption area may be calculated from the detected voltage, for example, but it does not have to be an absolute value, so that, for the absorption area of FIG. 9C, the same waveform as the absorption area may be obtained by subtracting the detected voltage of FIG. 9B from a predetermined value.

As described above, the rate of decrease of the reflected light in the Time II becomes the largest (the overlapping area positively changes most in a unit time), and the rate of increase of the reflected light in the Time IV becomes the largest (the overlapping area negatively changes most in the unit time). Then, as shown in FIG. 9D, a point at which the rate of increase changes from an increasing trend to a decreasing trend matches the Time II and a point at which the rate of increase changes from the decreasing trend to the increasing trend matches the Time IV.

The point at which a change from the positive trend to the negative trend occurs or the reverse occurs is a point at which a turning direction changes in a curved line on a plane, or a point of inflection. In light of the above, when an output signal demonstrates the point of inflection, it means that the spotlight matches the edge position of the test pattern. Therefore, when the point of inflection is accurately detected, the position of the edge may also be accurately specified.

(Specification of Edge Position)

Figure 10A:
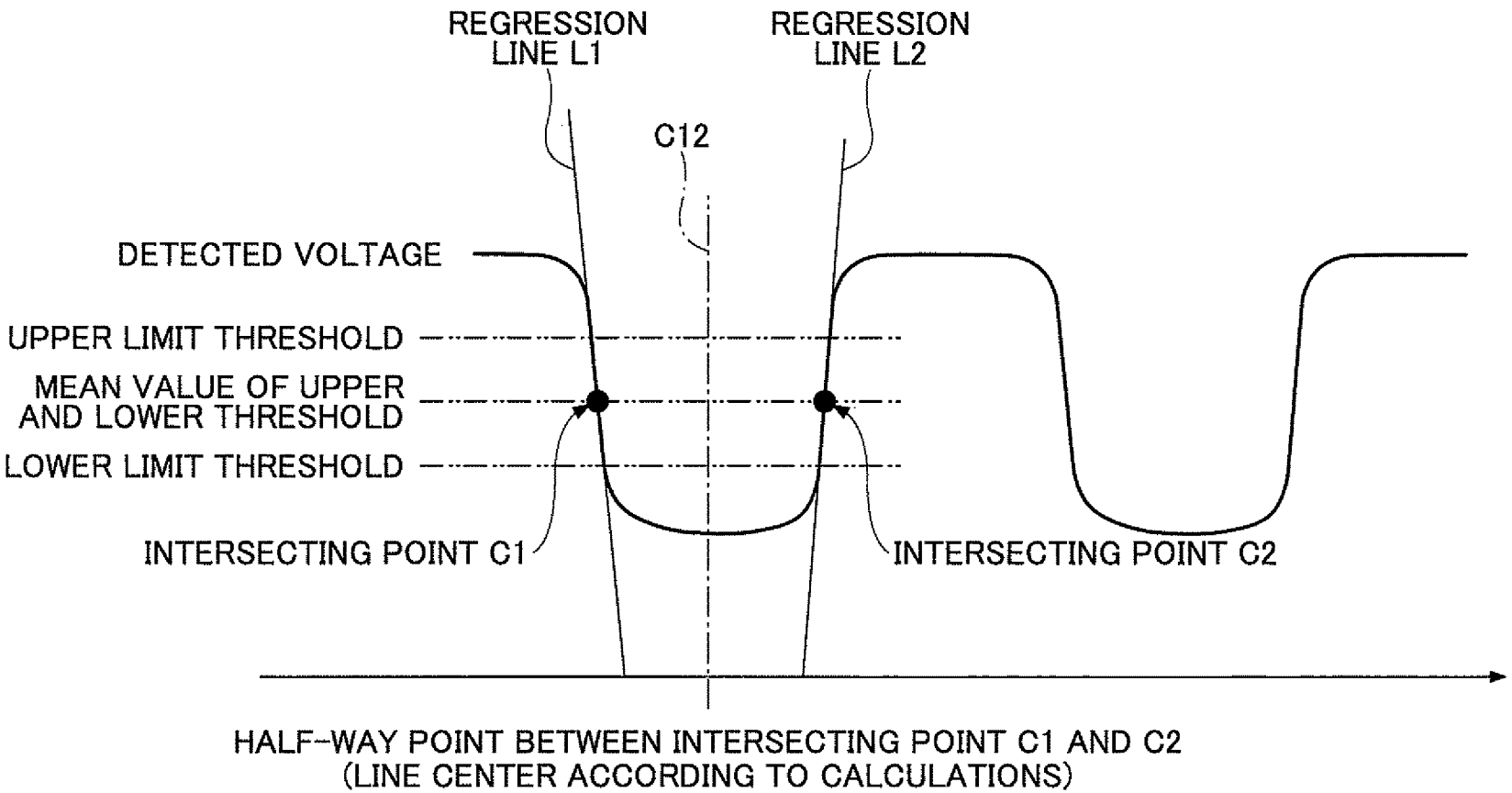
FIGS. 10A and 10B are exemplary diagrams which describe a method of specifying an edge position.
Figure 10B:
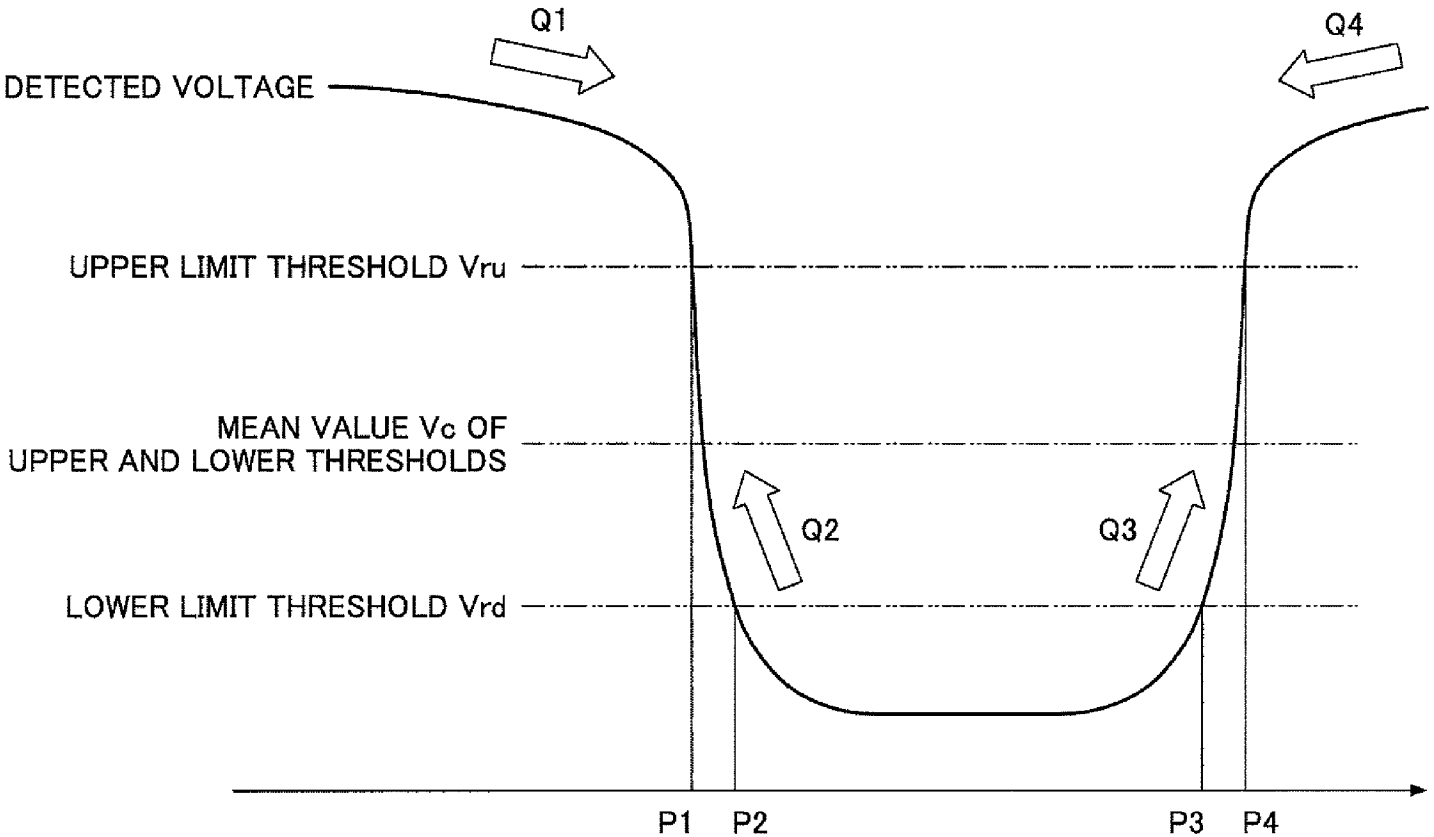

FIGS. 10A and 10B are exemplary diagrams which describe a method of specifying an edge position. FIG. 10A shows a schematic diagram of a detected voltage, while FIG. 10B shows an expanded view of the detected voltage. An approximate value of a point of inflection may be experimentally determined by the ejection timing correction process executing unit 526 or a developer. As described above, it is a position at which a slope is closest to zero when a derivative of the detected voltage or the absorption area is taken, for example.

An upper limit threshold Vru and a lower limit threshold Vrd of the detected voltage are predetermined such that this point of inflection is included. As described below, the CPU 301 calibrates an output of the light emitting element 402 and a sensitivity of the light receiving element 403 such that the detected voltage takes almost the same specific value (below-described 4 V) for a region without a test pattern. An amplitude correction process may cause local maximum values of the detected voltage to take almost the same constant value, so that the point of inflection is included between the upper limit threshold Vru and the lower limit threshold Vrd even when the detected voltage is unstable.

The ejection timing correction unit 615 searches a falling portion of the detected voltage in an arrow-indicated Q1 direction to store a point at which the detected voltage is no more than the lower limit threshold Vrd as a point P2. Next, it searches the same in an arrow-indicated direction Q2 from the point P2 to store a point at which the detected voltage exceeds the upper limit threshold Vru as a point P1.

Then, using multiple detected voltage data sets between the point P1 and the point P2, a regression line L1 is calculated and an intersecting point of the regression line L1 and a mean value Vc of the upper and lower thresholds is calculated and is set as an intersecting point C1.

Similarly, the ejection timing correction unit 615 searches a rising portion of the detected voltage in an arrow-indicated Q3 direction to store a point at which the detected voltage is no less than the lower limit threshold Vru as a point P4. Next, it searches the same in an arrow-indicated direction Q4 from the point P4 to store a point at which the detected voltage is no more than the upper limit threshold Vrd as a point P3.

Then, using multiple detected voltage data sets between the point P3 and the point P4, a regression line L2 is calculated and an intersecting point of the regression line L2 and a mean value Vc of the upper and lower thresholds is calculated and is set as an intersecting point C2. The ejection timing correction unit 615 specifies the intersecting points C1 and C2 as an edge position of two lines. According to a determining process of the upper and lower thresholds, the intersecting points C1 and C2 may be arranged to approximately match the point of inflection.

Thereafter, the ejection timing correction unit 615 calculates a difference between an ideal distance between the two lines of the test pattern and a distance between neighboring lines determined from the intersecting points C1 and C2. This difference is an impacting position offset amount of a position of an actual line relative to a position of an ideal line. Based on the calculated impacting position offset amount, the ejection timing correction unit 615 calculates a correction value for correcting a timing for causing liquid droplets to be ejected from the recording head 21 (a liquid droplet ejection timing) and sets the correction value to the head drive controller 312. In this way, the head drive controller 312 drives the recording head 21 with the corrected liquid droplet ejection timing, so that the impacting position offset is reduced.

(Accuracy Decreasing Factor)

In this way, for detecting an edge using detected voltage data between an upper limit threshold and a lower limit threshold, the edge cannot be detected unless a point of inflection is included between the upper limit threshold and the lower limit threshold. A width formed by the upper limit threshold and the lower limit threshold (two thresholds) is called a "threshold area". The threshold area, which has the detected voltage as a unit, may also be defined as an absorption area which corresponds to the detected voltage.

Figure 11:
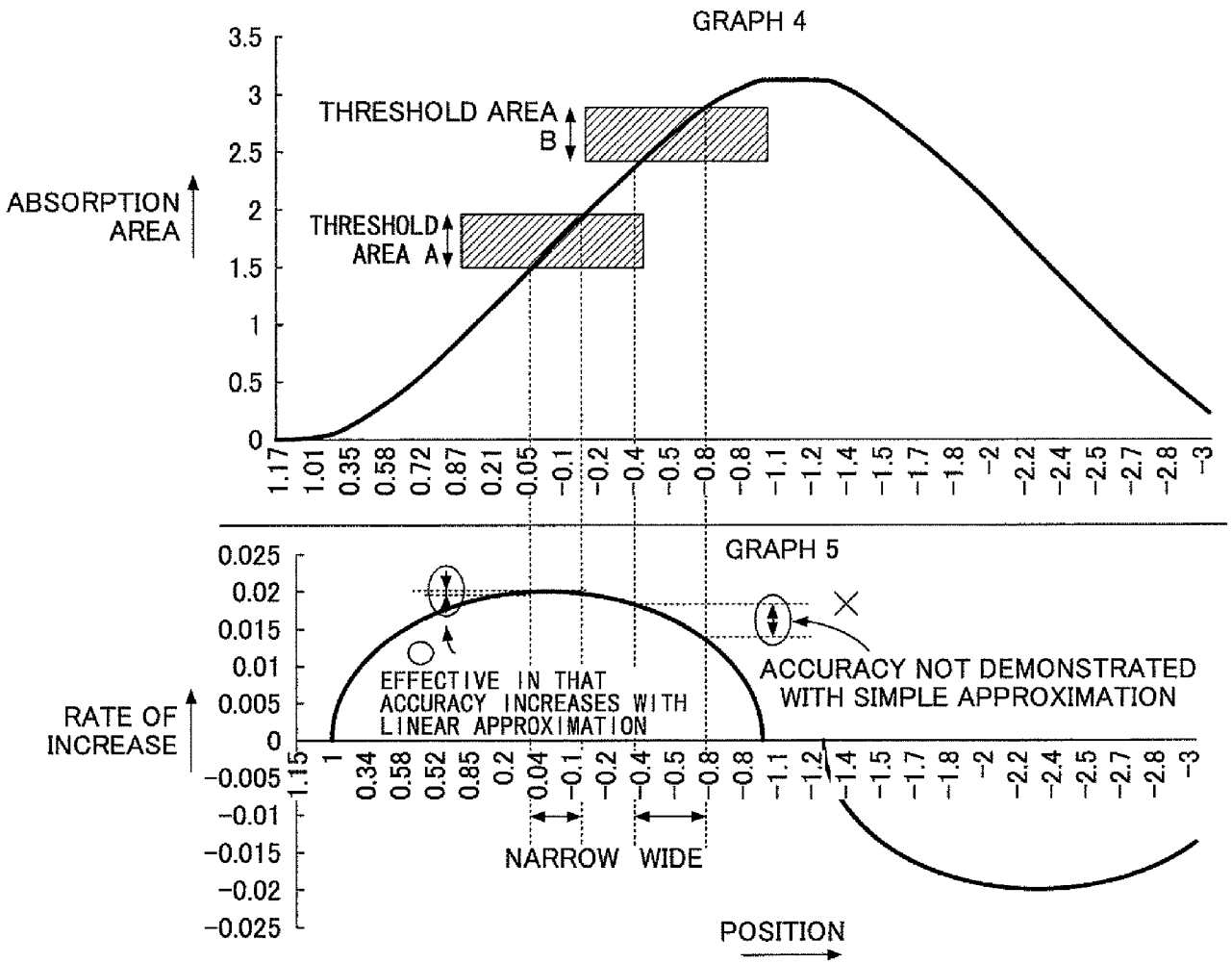
FIG. 11 is a diagram illustrating examples of an absorption area and an increase rate of the absorption area.

FIG. 11 is a diagram illustrating examples of an absorption area and an increase rate of the absorption area. As described in FIG. 9, when there is a point of inflection in a threshold area A in FIG. 11, the ejection timing correction unit 616 may accurately detect an edge position.

On the other hand, when there is a point of inflection in a threshold area B in FIG. 11, the ejection timing correction unit 615 may not detect an accurate edge position even though a regression line is determined from the threshold area A. Moreover, if it is known that a point of inflection is in the threshold area B, the threshold area may be moved from A to B in order for the ejection timing correction unit 615 to determine the regression line; however, a position of the point of inflection being greatly offset means that curves of the absorption area and the detected voltage could be deformed. For example, when the ejection timing correction unit 615 determines a regression line from a threshold area with a large slope of the curve, the intersecting points C1 and C2 may also be greatly offset. This is indicated by a lower portion of FIG. 11 showing that, while a width of a position which includes the vicinity of an apex may be estimated in a sufficiently narrow range in the threshold area A, it is difficult to estimate a width of a position which includes the vicinity of a point of inflection (which is not within a threshold area B in FIG. 11).

Therefore, it is seen that, when an amplitude of the detected voltage changes such that a point of inflection is not in the threshold area A, it is not preferable to specify an edge position from the threshold area A or to move a threshold area such that a point of inflection is included therein to determine an edge position.

Thus, the correction process executing unit 526 according to the present embodiment corrects amplitude of the detected voltage in a generally constant manner to cause the point of inflection to be included in the threshold area to accurately detect the edge position.

Figure 12A:
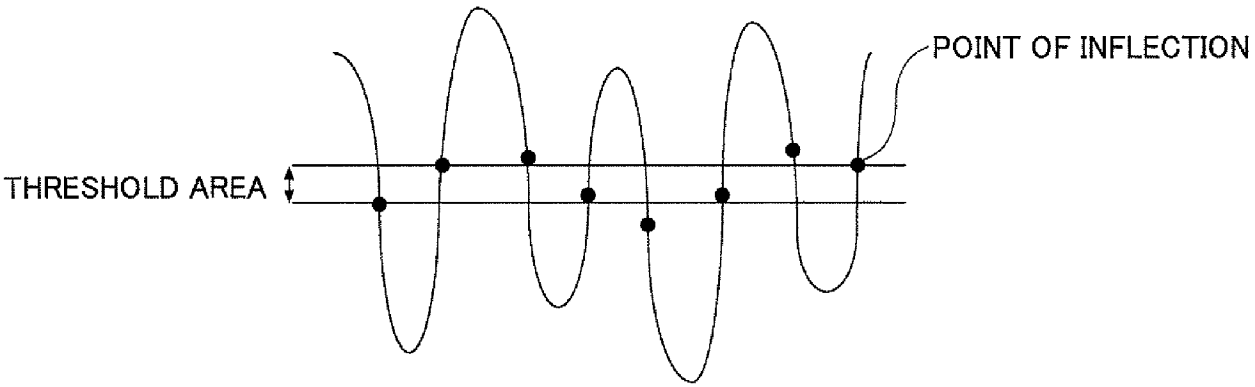
FIGS. 12A and 12B are diagrams respectively illustrating examples of a detected voltage with an unstable amplitude and the detected voltage after correcting the amplitude.
Figure 12B:
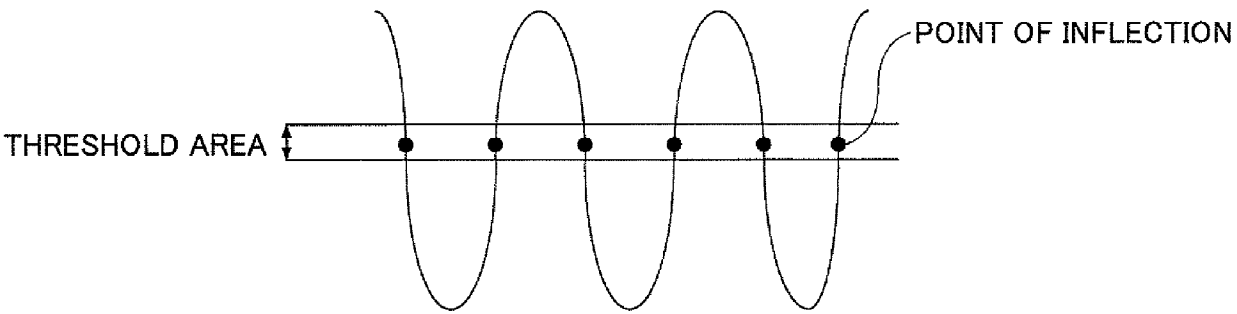

FIG. 12A shows an example of a detected voltage with an unstable amplitude, while FIG. 12B shows an example of a detected voltage after its amplitude is corrected. The detected voltage as shown in FIG. 12A is not commonly obtained; however, it is known that an amplitude varies when a print position offset sensor 30 reads a test pattern which is formed on a highly transmittant sheet material 150 such as a tracing paper. As shown, when the amplitude becomes unstable, the point of inflection falls off the threshold area. When the ejection timing correction unit 615 determines the intersecting points C1 and C2 with the threshold area not moved, the intersecting points C1 and C2 are determined from detected voltage data which do not include a point of inflection, so that the edge position ends up not being accurate. When the threshold area is moved such that it includes a point of inflection, there is no guarantee that an edge position may be accurately determined with a method of determining the intersecting points C1 and C2 before moving the threshold area.

On the other hand, as shown in FIG. 12B, local maximum values of the amplitude can be aligned to cause the point of inflection to be included in the threshold area and to cause the points of inflection to be concentrated in the vicinity of the center of the threshold area. In this way, in the same manner as the threshold A in FIG. 11, the ejection timing correction unit 615 may accurately detect an edge position with a simple approximation of determining a regression line.

While a tracing paper is used as an example in the present embodiment, the same problem arises for a highly transmittant sheet material 150. For example, the method of detecting the edge position according to the present embodiment is effective when paper is sufficiently thin even for plain paper other than tracing paper. Therefore, a process of correcting a liquid droplet ejection timing according to the present embodiment is not limited to the sheet material 150 made of a specific material, kind, or thickness. Moreover, it may be applied to a plain paper with a sufficient thickness.

(Diameter of Spotlight and Line Width of Test Pattern)

While it is arranged that Spot diameter d=Line width L of a test pattern in FIG. 9, an edge position can be detected even with "Spot diameter d>Line width L of the test pattern" or "Spot diameter d<Line width L of the test pattern".

Figure 13A:
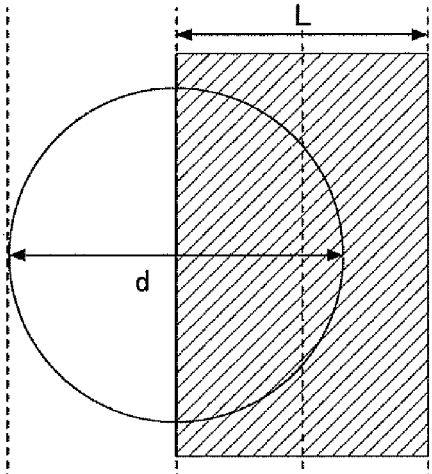
FIGS. 13A, 13B, 13C, and 13D are exemplary diagrams which describe a diameter of the spotlight and a line width of the test pattern.
Figure 13B:
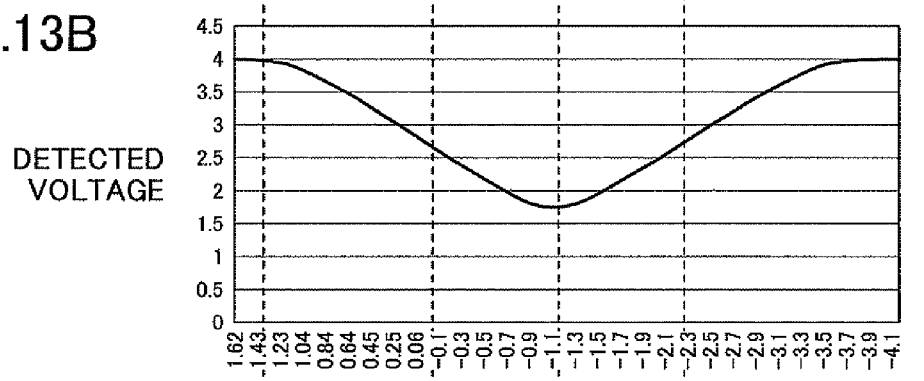
Figure 13C:
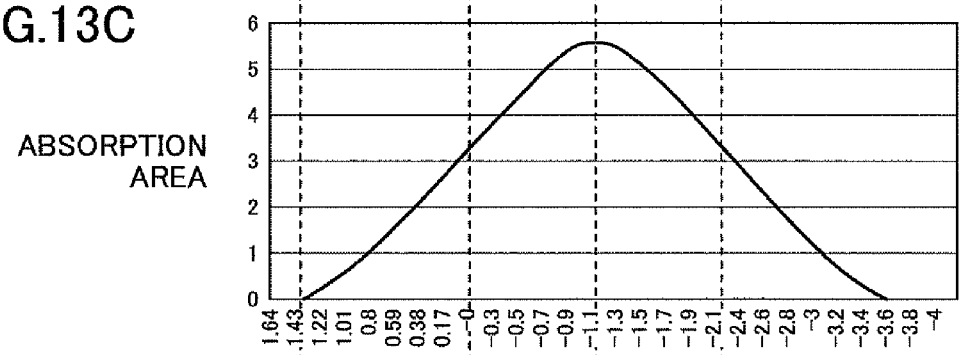

FIG. 13A shows an example of a test pattern and spotlight which have a relationship that Spotlight diameter d>Line width L of a test pattern. Here, it is assumed that "d/2<L<d". FIG. 13B shows an example of a detected voltage of a light receiving element, FIG. 13C shows an example of an absorption area, and FIG. 13D shows a rate of increase of the absorption area, which is a derivative of the absorption area of FIG. 12C.

Figure 13D:
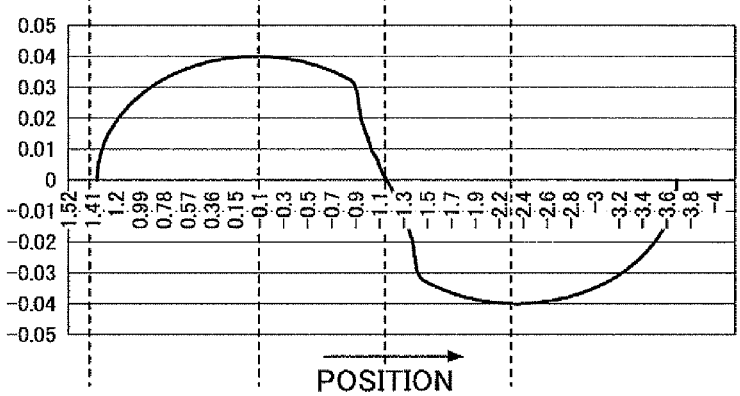

As Spot diameter d>Line width L of test pattern means that the spotlight and the test pattern do not overlap completely, the absorption area turns to a decreasing trend when a right edge of the spotlight gets over the test pattern and the rate of increase rapidly decreases as seen from the rate of increase of the absorption area in FIG. 13D.

However, in the present embodiment, as the intersecting points C1 and C2 may be obtained when detected voltage data in the neighborhood of the point of inflection is obtained, it suffices that the spotlight d is such that d/2<L. In other words, it suffices that the spot diameter d is not extremely large relative to the line width L of the test pattern.

Figure 14A:
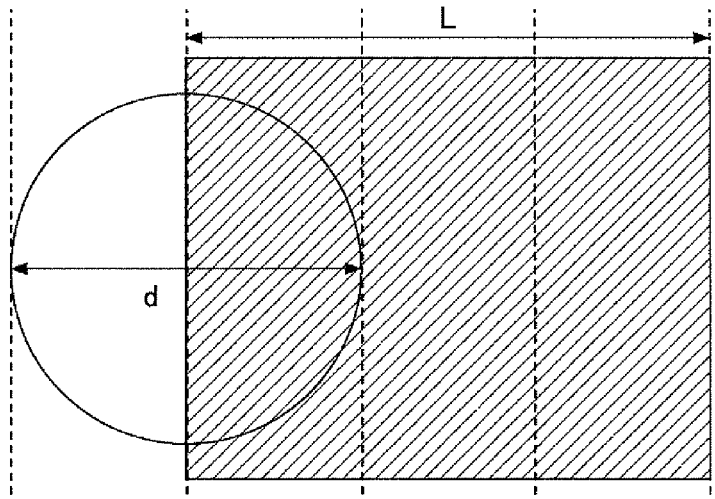
FIGS. 14A, 14B, 14C, and 14D are exemplary diagrams which describe the diameter of the spotlight and the line width of the test pattern.
Figure 14B:
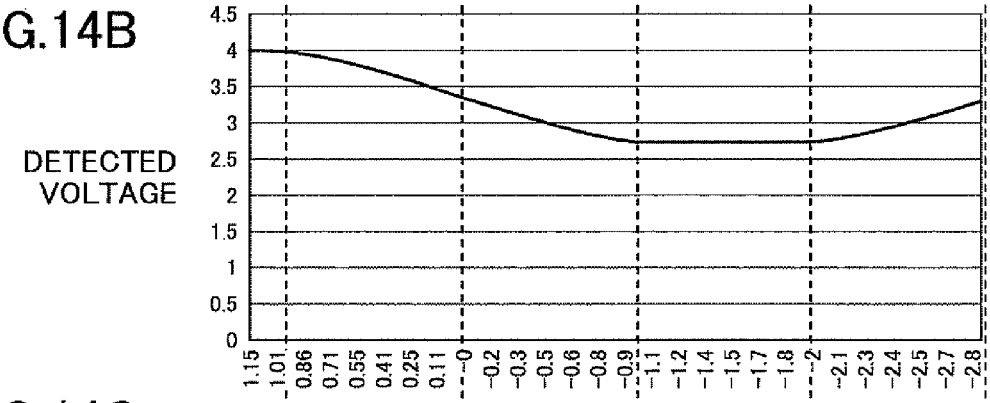

FIG. 14A shows an example of a test pattern and a spotlight which have a relationship that Spotlight diameter d<Line width L of a test pattern. FIG. 14B shows an example of a detected voltage of a light receiving element, FIG. 14C shows an example of an absorption area, and FIG. 14D shows an example of a rate of increase of the absorption area, which is a derivative of the absorption area of FIG. 14C.

Figure 14C:
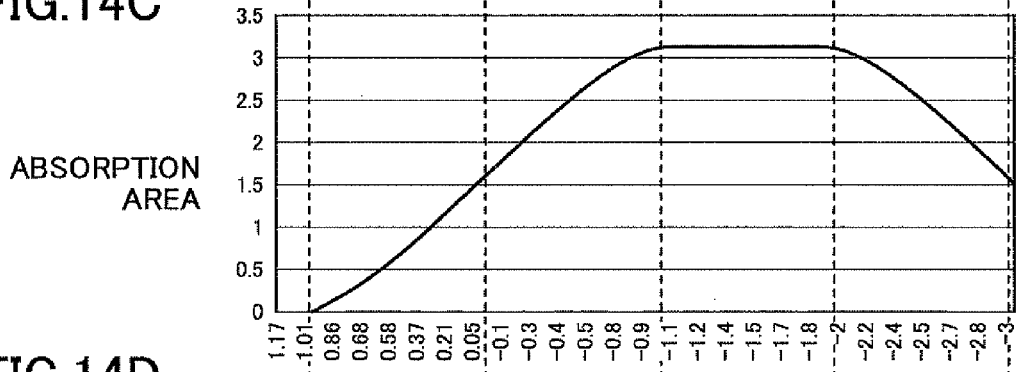
Figure 14D:
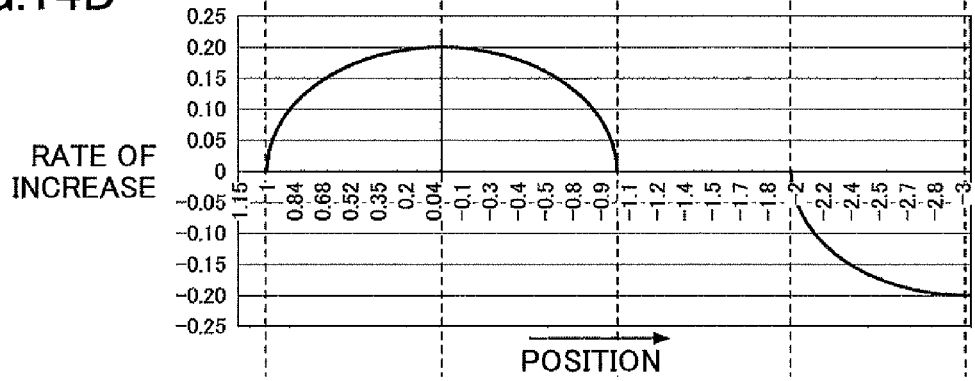

As Spot diameter d<Line width L of test pattern means that the spotlight and the test pattern continue to overlap completely, there occurs an area in which the detected voltage or the absorption area is constant as shown in FIGS. 14B and 14C. Moreover, as shown in FIG. 14D, there occurs an area in which the rate of increase of the absorption area is zero. Thereafter, the absorption area turns to a decreasing trend when a right edge of the spotlight gets over the test pattern, and the rate of increase slowly decreases (the rate of decrease increases).

In such a case, as in FIG. 9, detected voltage data sets in the neighborhood of the point of inflection are obtained sufficiently, making it possible for the ejection timing correction unit 615 to sufficiently determine the intersecting points C1 and C2.

(Case of Line-Type Image Forming Apparatus)

While the serial-type image forming apparatus 100 in FIGS. 3 and 4 is described as an example in the present embodiment, an impacting position offset amount may also be corrected with the same method in the line-type image forming apparatus 100. The line-type image forming apparatus 100 is briefly described.

Figure 15:
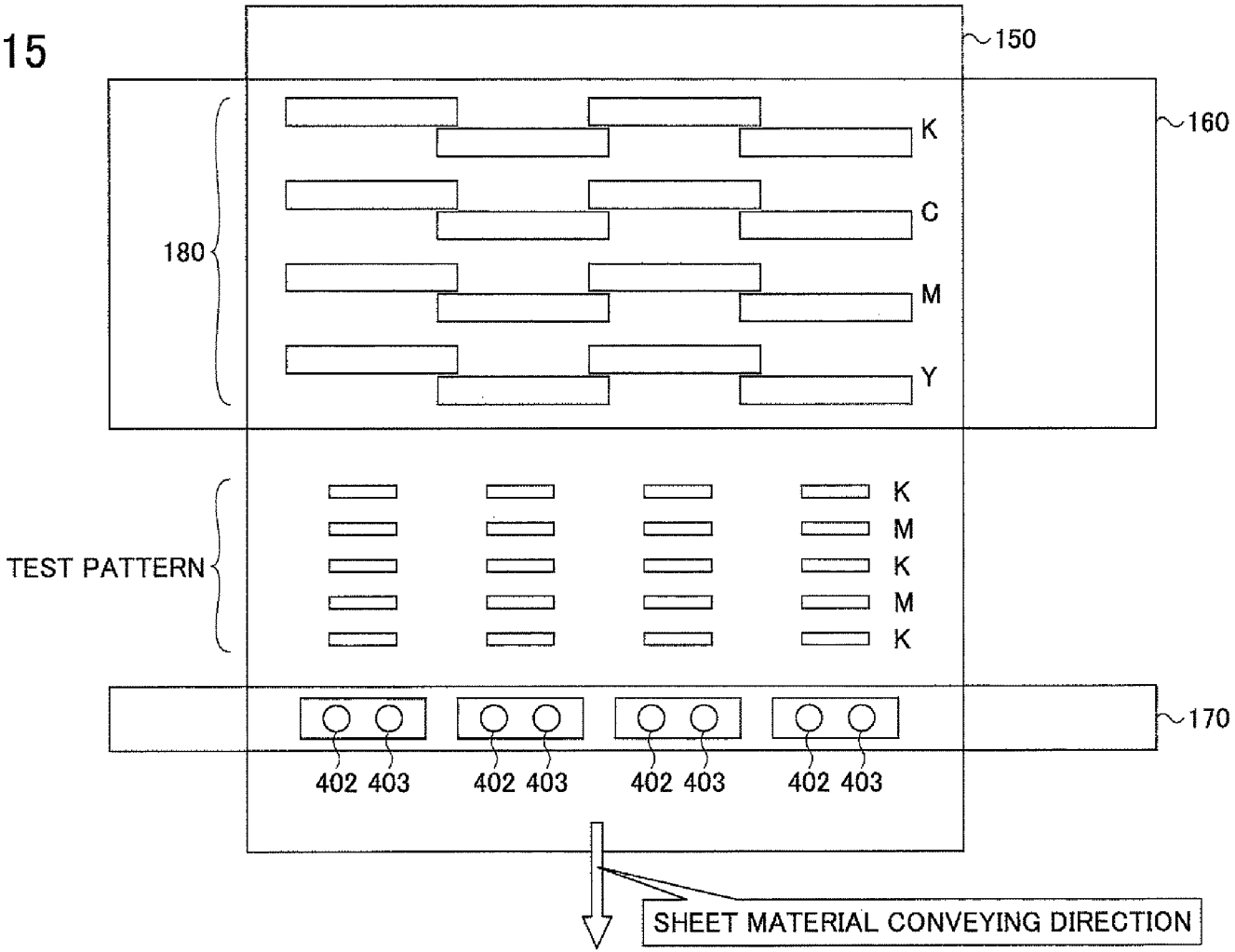
FIG. 15 is an exemplary diagram which schematically describes the test pattern and an arrangement of a head of a line-type image forming apparatus.

FIG. 15 is an exemplary diagram which schematically describes a test pattern and an arrangement of a head of a line-type image forming apparatus 100. A head fixing bracket 160 is fixed such that it is stretched from end to end in the main scanning directions orthogonal to a sheet material conveying direction. At the head fixing bracket 160 is arranged a recording head 180 of ink of KCMY from an upstream side to the whole area in the main scanning directions. The recording head 180 of the four colors is arranged in a staggered fashion such that edges overlap. In this way, liquid droplets are ejected to obtain a sufficient resolution even at an edge of the recording head 180, making it possible to suppress an increase in cost without a need to arrange one recording head 180 in the whole area in the, main scanning directions. One recording head 180 may be arranged in the whole area in the main scanning directions for each color, of an overlapped area in the main scanning directions of the recording head 180 of each color may be elongated.

Downstream of the head fixing bracket 160 is fixed a sensor fixing bracket 170 such that it is stretched from end to end in the main scanning directions orthogonal to the sheet material conveying direction. At the sensor fixing bracket 170, a number of print position offset sensors 30 are arranged, the number of print position offset sensors 30 being equal to the number of heads. In other words, one print position offset sensor 30 is arranged such that a part overlaps one recording head 180 in the main scanning directions. Moreover, one print position offset sensor 30 includes a pair of the light emitting element 402 and the light receiving element 403. The light emitting element 402 and the light receiving element 403 are arranged such that they are nearly parallel to the main scanning direction.

In such an embodiment of the image forming apparatus 100, each line which makes up the test pattern is formed such that a longitudinal direction of the line is parallel to the main scanning direction. When an impacting position offset of a liquid droplet of a different color is corrected with K as a reference, the image forming apparatus 100 forms a K line and an M line, a K line and a C line, and a K line and a Y line. Then, as in the serial-type image forming apparatus 100, an edge position of the CMYK test pattern is detected, and a liquid droplet ejection timing is corrected from the position offset amount.

As described above, even in the line-type image forming apparatus 100, a print position offset sensor 30 may be arranged properly to correct an impacting position offset.

(Amplitude Correction Process)

Figure 16A:
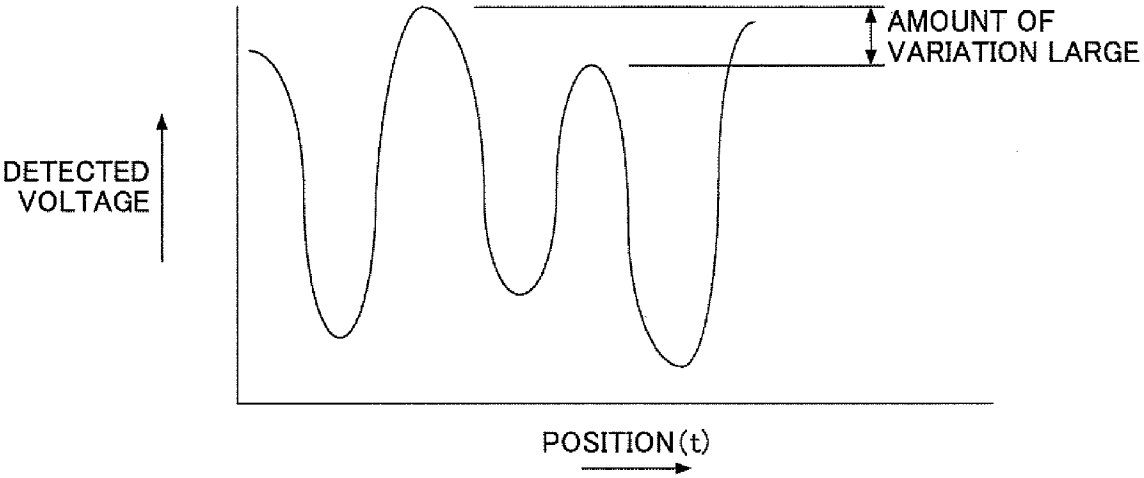
FIGS. 16A and 16B are exemplary diagrams which describe a signal correction.

Below, a signal correction of a detected voltage according to the present embodiment is described. FIG. 16A shows an example of a detected voltage of a light receiving element before correcting, while FIG. 16B shows an example of a detected voltage after an amplitude thereof is corrected.

FIG. 16A is a waveform of a detected voltage when a light receiving element has read a test pattern formed on a highly transmittant sheet material 150 such as a tracing paper. As an intensity of a reflected light of the sheet material itself changes, as shown in FIG. 16A, a local maximum value (a portion at which a plain surface is read) and a local minimum value (a portion at which a pattern is read) are uneven, so that a variation is large.

Figure 16B:
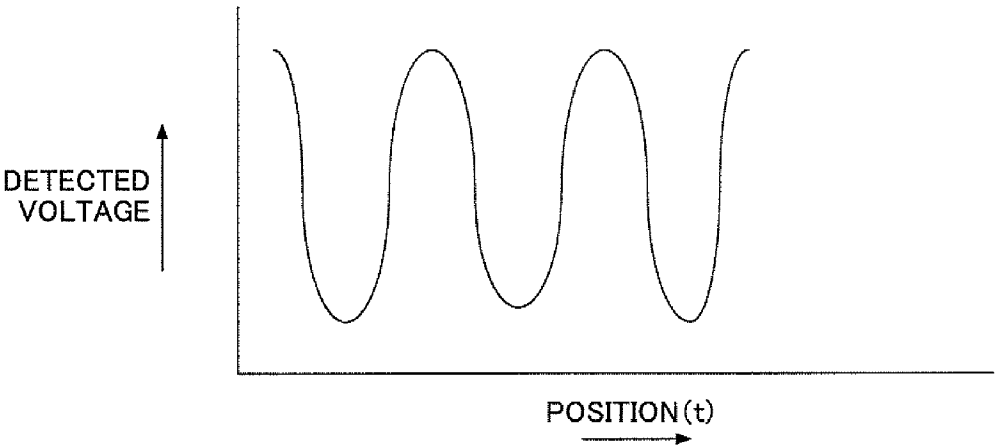

FIG. 16B is an example of a waveform of a detected voltage after an amplitude correction process. The signal correction of the present embodiment yields stable output data with a reduced variation of the local maximum and the local minimum values, making it possible to accurately calculate the subsequent impacting position offset amount.

Pre-processing is needed to perform the signal correction. Thus, the processing procedure is as follows:

(1) Pre-processing; and (2) Signal correction.

(Pre-processing)

Below, the pre-processing is described. The pre-processing may be divided into a pre-processing A and a pre-processing B. The pre-processing A includes the following processes on detected voltage data for a blank sheet status (background) before forming a test pattern.

Pre-processing A (i) N-times scanning (ii) Synchronization process (iii) Averaging (iv) Filtering process The pre-processing B includes the following processes on detected voltage data after forming the test pattern.

Pre-processing B (i) n-times scanning (ii) Synchronization process (iii) Averaging (Pre-Processing A)

Pre-processing A-(i)

Figure 17A:
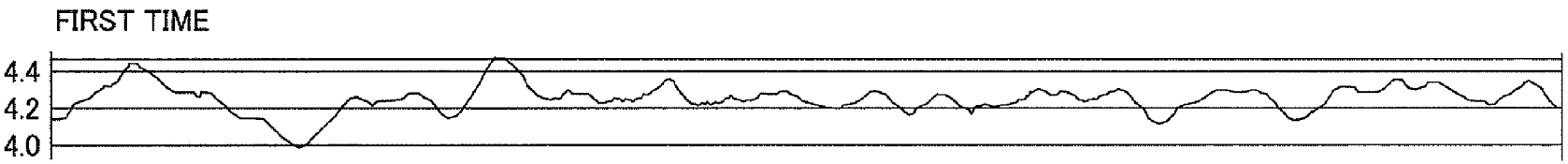
FIG. 17A and 17B are diagrams illustrating one example of measurement results of n-times scanning.
Figure 17B:
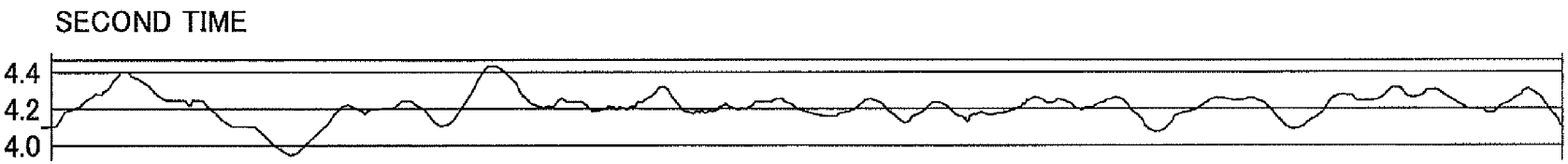

FIGS. 17A and 17B are diagrams illustrating one example of measured results of n-times scanning in A-(i). Before the n-times scanning, an n-times scanning unit performs a sensor calibration for a sheet material (e.g., a plain paper, a tracing paper). The n-times scanning unit requests of the CPU 301 that a detected voltage of a reflected light which is detected by a light receiving element and eventually converted by an A/D conversion circuit 523 take a certain constant value. The CPU 301 performs feedback control such that the detected voltage falls within a certain range. For example, when the detected voltage is greater than 4.4 V, a light emitting amount of the light emission controller 511 is decreased, while when the detected voltage is less than 4.0 V the light emitting amount of the light emission controller 511 is increased. As shown in FIGS. 17A and 17B, the sensor calibration causes the detected voltage to fall within a 4.0-4.4 V range. A sensor calibration may be performed by a PI control or a PID control with a target value being set to 4.0-4.4 V.

This detected voltage is the above-described Vsg2 (a detected voltage for an area in which a test pattern is not formed). The n-times scanning unit obtains n detected voltage data sets as shown in FIGS. 17A and 17B.

Pre-processing A-(ii)

Figure 18:
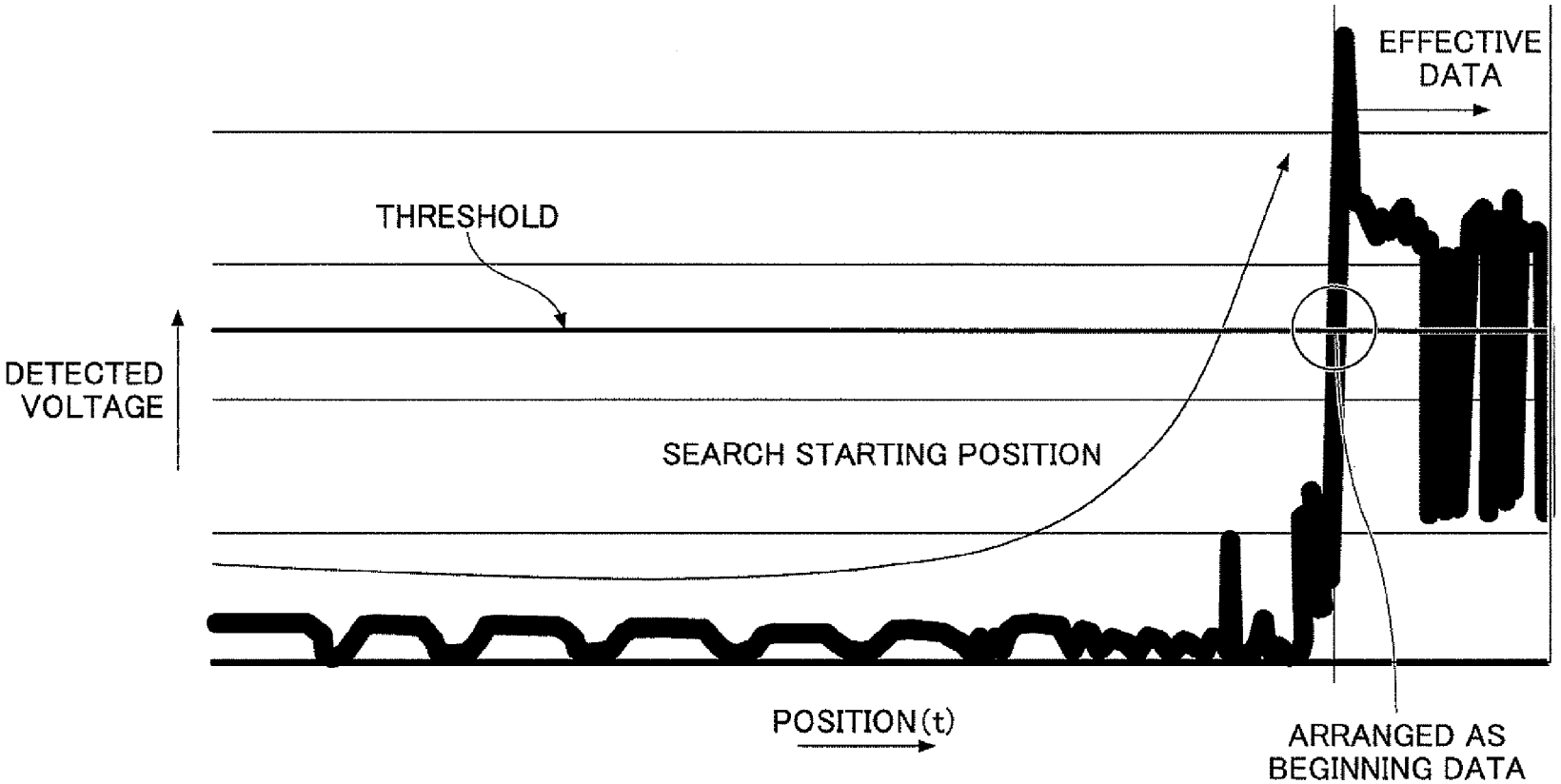
FIG. 18 is an exemplary diagram which describes a synchronization process.

FIG. 18 is an exemplary diagram which describes a synchronization process of A-(ii). An averaging unit calculates an average of n detected voltage data sets which are obtained by the n-times scanning unit. The detected voltage data sets are detected even when what is other than the sheet material 150 is scanned by the spotlight; however, what is needed is only a detected voltage obtained from the sheet material 150. Therefore, the synchronization unit aligns a start of n detected voltage data sets to a sheet edge of the sheet material 150.

In order to start n detected voltage data sets from the sheet edge, the synchronization unit detects a point at which the detected voltage data first exceed the threshold value as a sheet edge of the sheet material 150. The detected voltage data sets for averaging are data sets at the time the threshold value is exceeded and beyond. (The detected voltage data set which exceeded the threshold value is handled as a starting first data set.) When a target value for the sensor calibration is set to 4.0 V, the threshold value takes a value of around 3.5-3.9 V, which is somewhat smaller.

In addition to such a synchronization method as described above, position information in the main scanning directions that is detected by the encoder sensor 42 may be collated with the detected voltage data to store the collated result, and the position information may be matched to synchronize n detected voltage data sets.

Pre-processing A-(iii)

The averaging unit calculates an average of n detected voltage data sets starting from a sheet edge. The n detected voltage data sets include n detected voltage data sets for each position with a sheet edge of the sheet material 150 as a reference position (a position being zero) in a scanning direction. The position, which is a position of the carriage 5 that is detected by the encoder sensor, corresponds on a one on one basis with a centroid position of the spotlight, so that it is described below as the centroid position of the spotlight. In other words, the averaging unit calculates an average of n detected voltage data sets for each centroid position.

Pre-processing A-(iv)

Figure 19:
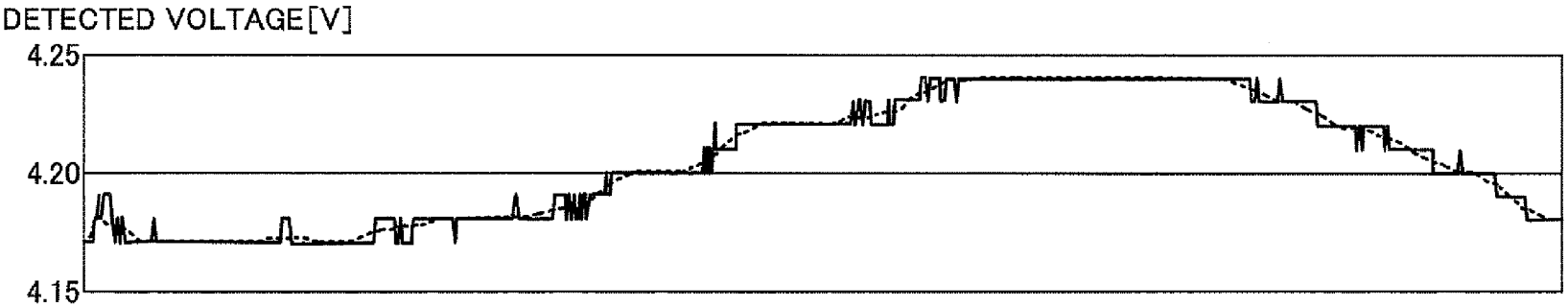
FIG. 19 is an exemplary diagram which describes a filtering process.

FIG. 19 is an exemplary drawing for explaining a filtering process. A filtering processing unit performs filtering processing on an average value of detected voltage data sets for each centroid position that is averaged by the averaging unit. More specifically, m detected voltage data sets (m in total, including a targeted data set and data sets preceding and following the targeted data set), are extracted to calculate an average. In this way, a measured noise may be reduced and a mismatch of detected voltage data sets which could not be completely synchronized in the synchronization process may be reduced.

In FIG. 19, a solid line waveform is detected voltage data before the filtering process and a dotted line waveform is detected voltage data after the filtering process. It is seen that the detected voltage data before the filtering process, which shows a step-shaped change as it is impacted by a resolution of the A/D conversion circuit 523, becomes smooth through the filtering process.

(Pre-processing B)

Pre-processing B-(i)

Figure 20A:
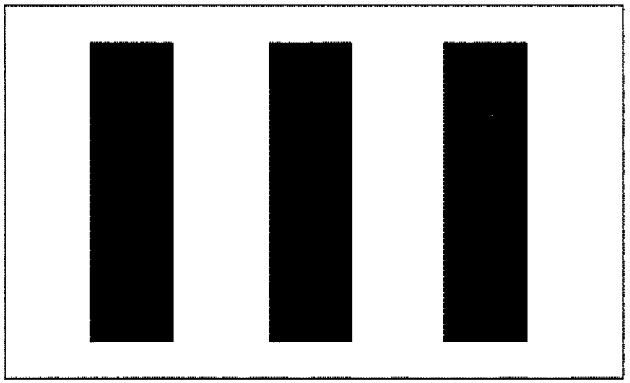
FIGS. 20A and 20B are exemplary diagrams which describe n-times scanning.
Figure 20B:
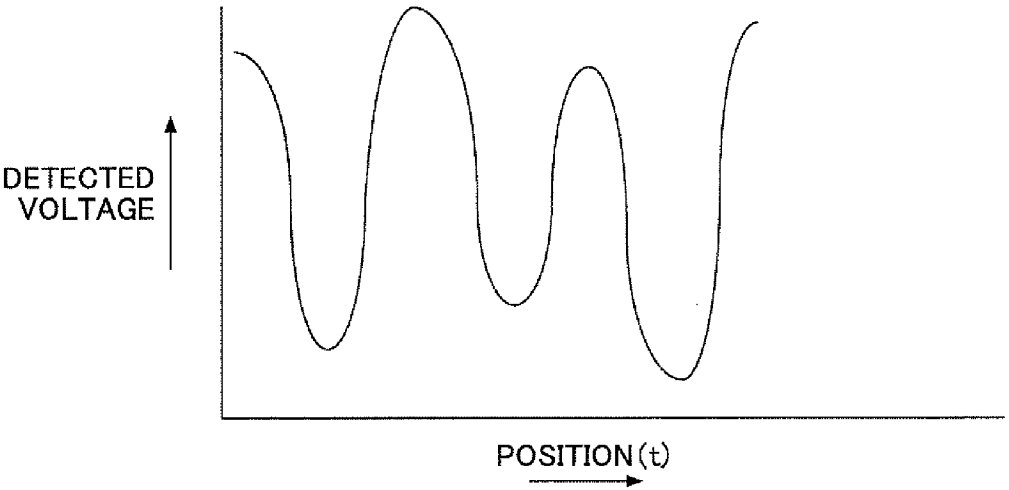

FIGS. 20A and 20B are exemplary diagrams which describe n-times scanning of B-(i). In FIG. 20A, a test pattern is formed on the sheet material 150 on which the n-times scanning of A-(i) has been performed. FIG. 20B shows a waveform of detected voltage data when a reflected light from the sheet material 150 on which a test pattern is formed is received by a light receiving element. The n-times scanning unit obtains such data n times.

Pre-processing B

Figure 21A:
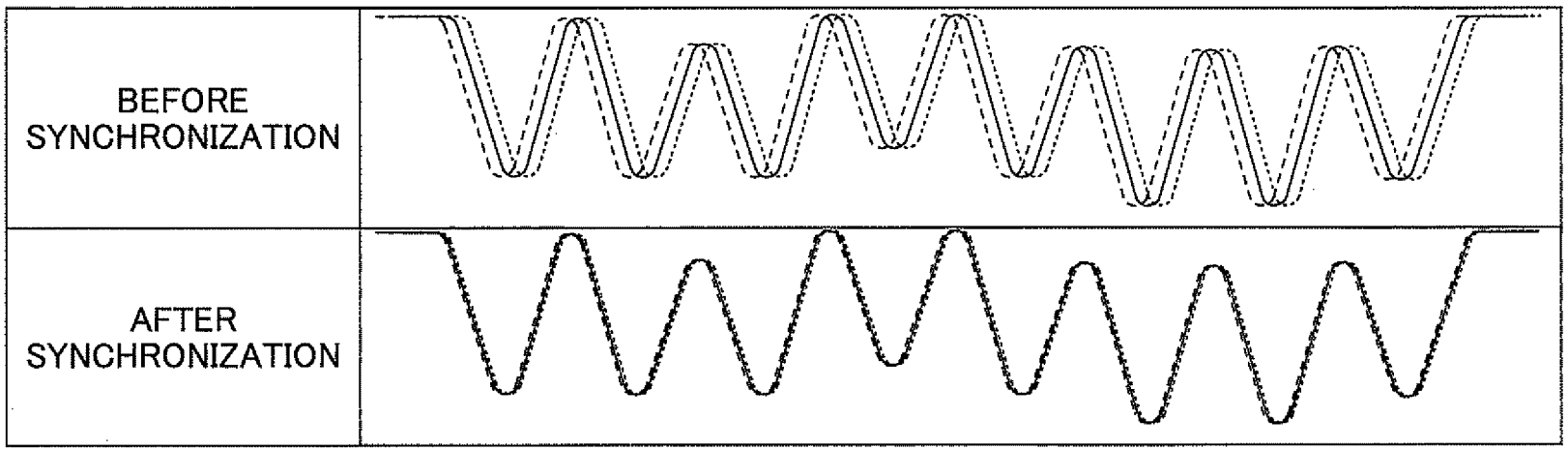
FIGS. 21A and 21B are exemplary diagrams which describe a synchronization process.

FIG. 20A is an exemplary diagram which explains a synchronization process of B-(ii). The upper section schematically shows detected voltage data before synchronization while the lower section schematically shows detected voltage data after synchronization. Unlike before forming the test. data, after forming the test data, local minimum values themselves and local maximum values themselves of n-times detected voltage data may be matched to align the edge positions. There are a number of methods for matching the local maximum values themselves and the local minimum values themselves (although it is difficult to match them perfectly) of waveform data as in FIGS. 21A and 21B.

As in A-(ii), a relatively simple method is to align a start of n detected voltage data sets to a sheet edge of the sheet material 150. If a test pattern is formed at the same position relative to a sheet edge, local maximum values and local minimum values of multiple detected voltage data sets may also be aligned at the same position.

Moreover, as in A-(ii), position information in the main scanning direction that is detected by the encoder sensor 42 may be collated with the detected voltage data to store the collated result, and position information may be matched to synchronize n detected voltage data sets.

Figure 21B:
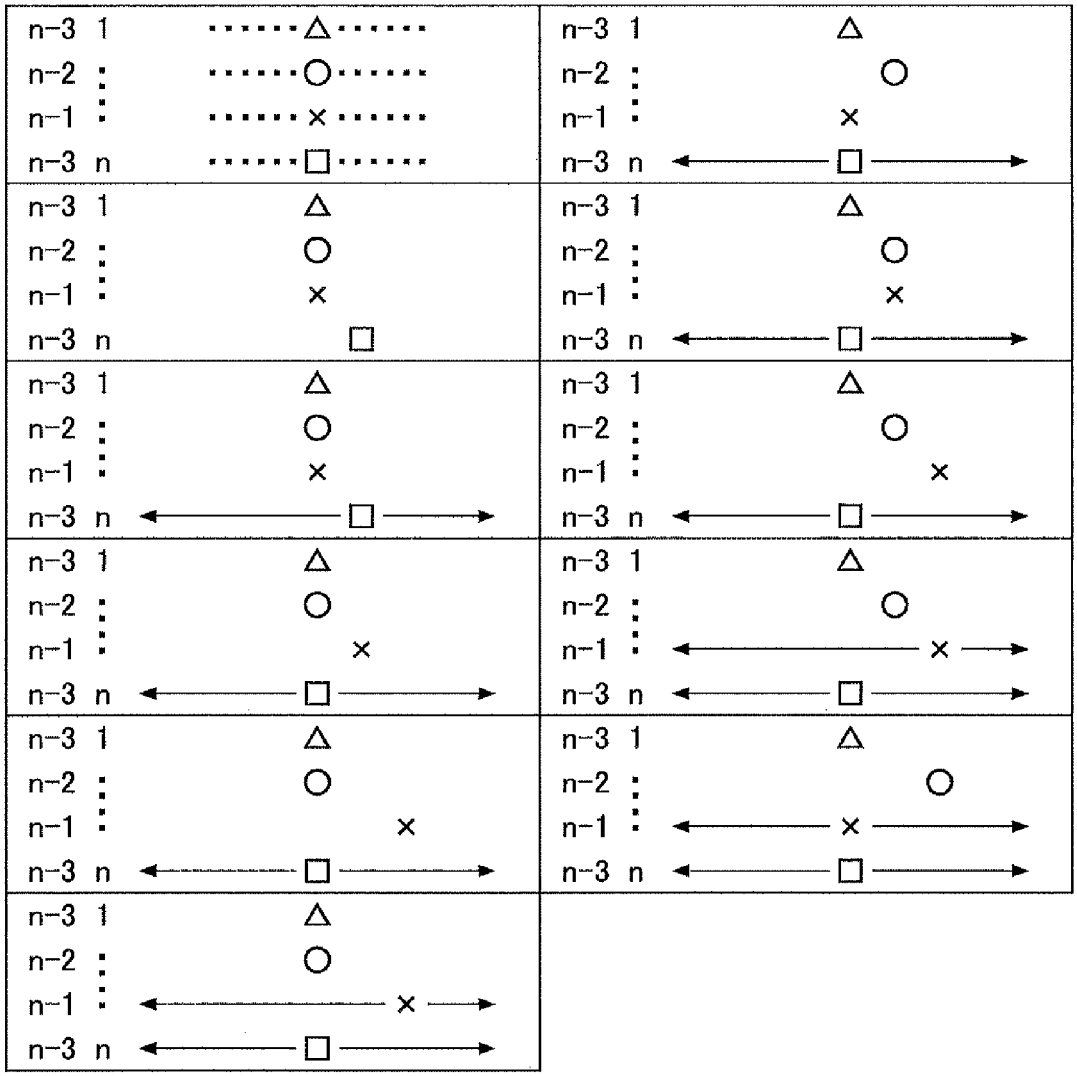

Moreover, the synchronization unit may also determine the position of n detected voltage data sets such that an offset of n detected voltage data sets becomes minimal while staggering positions of n detected voltage data sets. FIG. 21B schematically shows this procedure. First, the synchronization unit aligns a start of n detected voltage data sets to a sheet edge of the sheet material 150 as an initial value. The synchronization unit calculates a squared sum of a difference of two data sets taken out of n data sets according to all combinations. Then, a total of the squared sum of the difference for all centroid positions is calculated.

Next, n−1 out of n detected voltage data sets are fixed, while a centroid position of the remaining one detected voltage data set is offset by one unit. While it is preferable that the one unit of an amount to be offset corresponds to one pulse of an encoder sensor, several to several tens of pulses may be set as the one unit, taking into account calculation time. With the centroid position of the nth detected voltage data set being offset by one unit, the squared sum of the difference is calculated and a total of the squared sum of the difference of each centroid position is calculated. Moreover, while offsetting a centroid position of the nth detected voltage data set by one unit to a predetermined search range (for example, about a half of the line width), a total of the squared sum of the differences of all the centroid positions is calculated.

Next, the synchronization unit fixes n−2 out of n detected voltage data sets to offset the centroid position of an (n−1)-th detected voltage data set by one unit and calculates the squared sum of the difference and also calculates a total of the squared sums of the differences of all the centroid positions. Moreover, while offsetting a centroid position of the (n−1)-th detected voltage data set by one unit, the synchronization unit offsets the centroid position of the n-th detected voltage data set by one unit, calculates the squared sum of the difference and calculates a total of the squared sums of the differences of all the centroid positions.

While offsetting a centroid position of the (n−1)-th detected voltage data set further by one unit (by a total of two units), the synchronization unit offsets the centroid position of the n-th detected voltage data set by one unit to a search range, calculates the squared sum of the difference and calculates a total of the squared sums of the differences of all the centroid positions. While offsetting the centroid position of the (n−1)-th detected voltage data set by one unit to the search range, the same process (offsetting the centroid position of the n-th detected voltage data set by one unit to the search range, calculating the squared sum of the differences and calculating a total of the squared sum of the differences of all of the centroid positions) is repeated.

Next, the synchronization unit fixes n−3 out of n detected voltage data sets to offset the centroid position of the (n−2)-th detected voltage data set by one unit and calculates the squared sum of the difference and also calculate a total of the squared sum of the differences of all of the centroid positions. Moreover, while offsetting a centroid position of the (n−2)-th detected voltage data set by one unit, the synchronization unit offsets the centroid position of the (n−2)-th detected voltage data set by one unit to the search range, calculates the squared sum of the difference and calculates a total of the squared sum of the differences of all of the centroid positions.

Furthermore, while offsetting a centroid position of the (n−2)-th detected voltage data set by one unit, the synchronization unit offsets the centroid position of the (n−1)-th detected voltage data set by one unit, and, in that state, offsets the centroid position of the n-th detected voltage data by one unit to the search range and calculates the squared sum of the difference and calculates a total of the squared sum of the differences of all of the centroid positions.

Moreover, while offsetting a centroid position of the (n−2) th detected voltage data set by one unit, the synchronization unit offsets the centroid position of the (n−1)-th detected voltage data set further by one unit (by a total of two units), and, in that state, offsets the centroid position of the nth detected voltage data by one unit to the search range, calculates the squared sum of the difference and calculates a total of the squared sum of the differences of all of the centroid positions. The synchronization unit performs the same process by offsetting the centroid position of the (n−1)-th detected voltage data set by one unit to the search range.

While offsetting a centroid position of the (n−2)-th detected voltage data set further by one unit (a total of two units), the synchronization unit repeats the same process on the (n−1)-th detected voltage data set and the n-th detected voltage data set. The process as described above is repeated until a number of detected voltage sets which has not moved out of n detected voltage data sets becomes one, effectively offsetting in all combinations of centroid positions of all of the detected voltage data sets.

The synchronization unit determines a relative centroid position of n detected voltage data sets when a total of a squared sum of the differences for all of the centroid positions becomes minimal as a centroid position after the synchronization process.

Pre-processing B-(iii)

The averaging unit calculates an average of n detected voltage data sets which are synchronized. As n detected voltage data sets exist for each position, the averaging unit calculates an average of the n detected voltage data sets for each centroid position.

Amplitude correction process

First, the synchronization processing unit 613 performs a synchronization process before the amplitude correction process. The synchronization processing unit 613 aligns a sheet edge of the detected voltage data after a test pattern print to which the pre-processing of B-(i)-(iii) is applied and the detected voltage data before the test pattern print to which the pre-processing of A-(i)-(iv) is applied.

As in A-(ii), the alignment is performed by setting a detected voltage data set which first exceeded the threshold value as a starting first data set. Below, for purposes of explanations, the detected voltage data set before forming the test pattern is called blank sheet measurement data Vs2 and the detected voltage data set after forming the test pattern is called pattern measurement data Vs1.

First, ideas for determining data z to be operated on are described. Even when no image is formed on the sheet material 150, a reflected light or a reflectance of the sheet material 150 varies due to characteristics of the sheet material 150 such as transmissivity and crystallinity. Moreover, the reflectance may also vary due to an optical axis offset which is caused by a slope of a platen, etc., whose support of the sheet material 150 is not constant, or unevenness of the sheet material 150, even though there is a difference in degree depending on a magnitude of directivity of the sheet material 150.

Moreover, factors for varying reflectance that are related to a position of a spotlight which scans the sheet material 150 are too numerous to mention, such as the distance between the light receiving element and the sheet material 150 not being constant, a supporting mechanism of the platen 40, a vibration caused by various phenomena, a power supply variation, an affinity from a control point of view, etc.

However, while there are various factors for the variation, the variation of the reflectance may be expressed as a function of position or time without distinguishing among the different factors. Such a variation of the reflectance is to be called a background variation.

Below, in order to facilitate the explanations, a description is given using an easy-to-image example:

A function of position or time is set to be a function of time;

A background variation is set to be a function Kbg of time;

A recording medium is set to be a blank sheet of paper;

A change which is sought to be detected by a light receiving element is set to be a position of ink which is ejected onto a sheet of paper;

For securing significant figures or for the purpose of arithmetic operation, a suitable index is set to be a maximum potential Vmax; and A value to be measured by a sensor is set to be a voltage value V.

First, a mechanism in which a pigment of ink absorbs the light is considered. A photon which is incident onto the ink is absorbed when it falls below a pigment-specific energy state. (This is understood since optical energy is proportional to the number of vibrations and a color changes due to the number of vibrations for visible light.) An energy state of the pigment, which may be changed by applying energy from outside, may, from an industrial point of view, often be assumed to be constant unless a particularly intentional control is conducted.

Here, considering the case in which it may be assumed constant, the energy state of the pigment is assumed to have a probability that the pigment does not take in the light, so that this constant value is assumed to be Ki (<1). With an incident light assumed as 1, a probability of preventing a reflected light from being fed back (a reflected light rate) becomes (1−Ki). For example, with Ki assumed as 0.3, 0.7 of the light may not be fed back as the reflected light.

What the light receiving element according to the present embodiment seeks to detect is a change of the reflected light rate (1−Ki) whose amount differs for each position. Thus, in order to quantify the reflected light rate (1−Ki), it is desirable that a function (1−Ki) of a position and a measured voltage be proportional.

In other words, with the measured voltage assumed as V, and assuming that $V \propto (1-Ki)$, the measured voltage V is proportional to the reflected light rate.

However, there is actually a background variation, yielding $V \propto Kbg \times (1-Ki)$.

Now, setting a variation (1−Ki) to be processed as Z yields, $V \propto Kbg \times Z \Leftrightarrow Z \propto (1/Kbg \times V$.

Appropriately determining Vmax yields $$Z=(\mathrm{Vmax}/Kbg)\times V \quad (1)$$

Equation (1) shows that, when the time function Kbg and V are the same time function, the measured voltage in which the background variation is included may be corrected such that it may be handled as if there is no background variation.

Realistically, due to the nature of Kbg, however, Kbg and V may not be measured at the same time; thus, Kbg and V could respectively have been measured and the time axes could have been aligned to measure the Kbg and V of the same position. The synchronization process of the signal correction process corresponds to such a process.

Each variable of the Equation (1) denoted with data described in the present embodiment has the following correspondence:

Kbg=Vs2;

V=Vs1;

Z=Vsg=z; and

Vmax=a maximum value (4 V, for example) of Vsg

In practice, Z becomes last data to be operated on, so that it does not necessarily correspond to Vsg, which is actually measured; however, as Z represents data obtained in lieu of Vsg, it is set that "Z=Vsg" and further that "Z=z". Moreover, Vmax, which may be determined appropriately, is set to be a maximum value of Vsg, or an ideal amplitude of Vsg as z is data to be operated on. According to the above, the Equation (1) may be rewritten as the following equation:

$$z=\mathrm{Vmax}\times Vs1/Vs2 \quad (2)$$

Figure 22A:
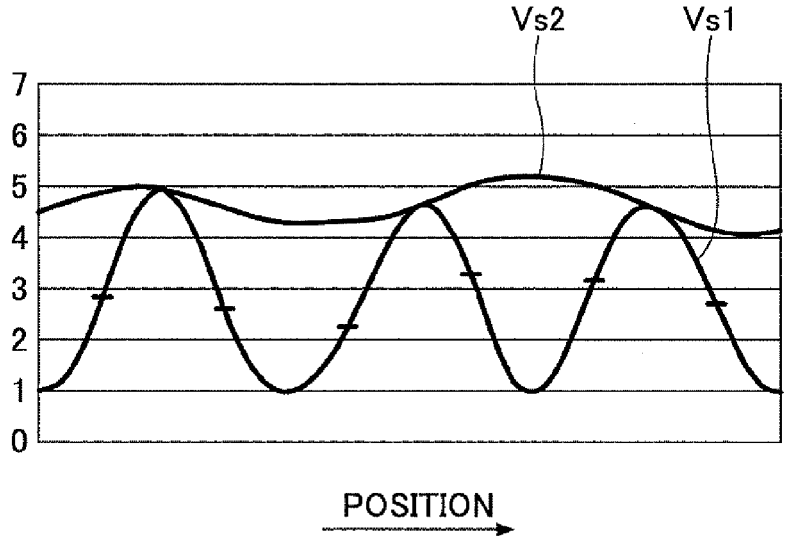
FIGS. 22A and 22B are exemplary diagrams which schematically describe data z to be operated on that are obtained from Vs2 and Vs1.
Figure 22B:
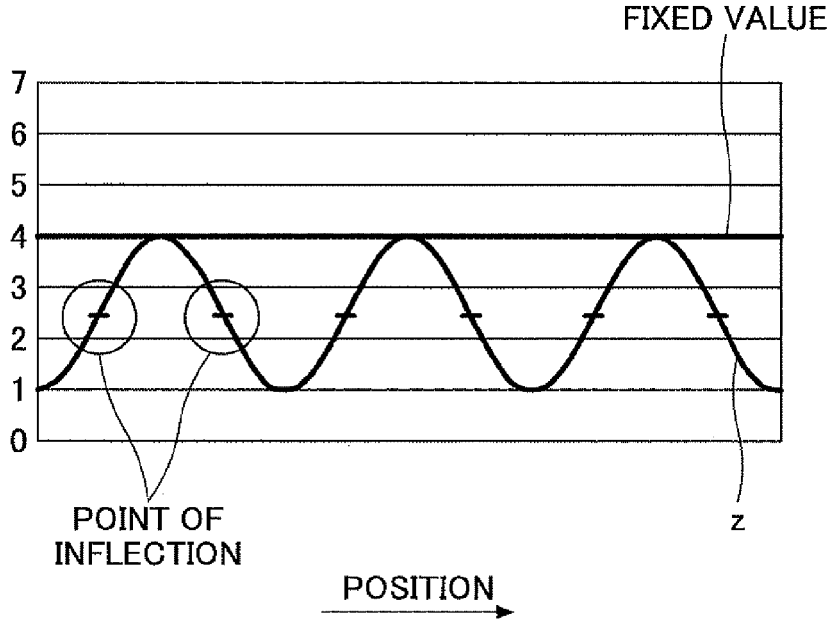

FIGS. 22A and 22B are exemplary diagrams which schematically explain data z to be operated on that are obtained from Vs1 and Vs2. In FIG. 22A Vs1 and Vs2 are shown as overlapping into one, while data z to be operated on and Vmax are shown in FIG. 22B.

According to Equation (2), Vs1/Vs2 makes it possible to erase a background variation which is included in both. Moreover, when the spotlight irradiates where there is no test pattern, Vs1 becomes equal to Vs2, while when it irradiates where there is a test pattern, Vs1 takes a local minimum value. This indicates that Vs1/Vs2 represents, in what ratio Vs1 which includes a variation at a certain position is included with Vs2 as a reference, or a ratio of a blank sheet measurement data and pattern measurement data when the background variation is removed.

Therefore, it is seen that, when Vmax is multiplied by this ratio, the background variation is removed, and data z to be operated on with a constant amplitude that take a local minimum value at a test pattern portion and a local maximum value at a plain surface portion are obtained.

Based on the above-described concepts, the amplitude correction processing unit 614 performs the arithmetic operation in Equation (2). With Vs1 and Vs2 already being determined, Vmax is a predetermined fixed value Vmax (e.g., 4.0 V). Therefore, the amplitude correction processing unit 614 may obtain data z to be operated on with a constant amplitude as shown in FIG. 22B. Thereafter, the ejection timing correction unit 615 may determine the intersecting points C1 and C2 as edge positions as described above.

The fixed value Vmax does not have to be fixed, so that it may be a median value or an average value of Vsg2 which correlates with a local maximum value. Vsg2 for n-times scanning that is performed by the pre-print pre-processing unit 611 before the test pattern is formed becomes the maximum value of the detected voltage after the test pattern is formed, so that it may be assumed as the fixed value Vmax.

(Operation Procedure)

Figure 23:
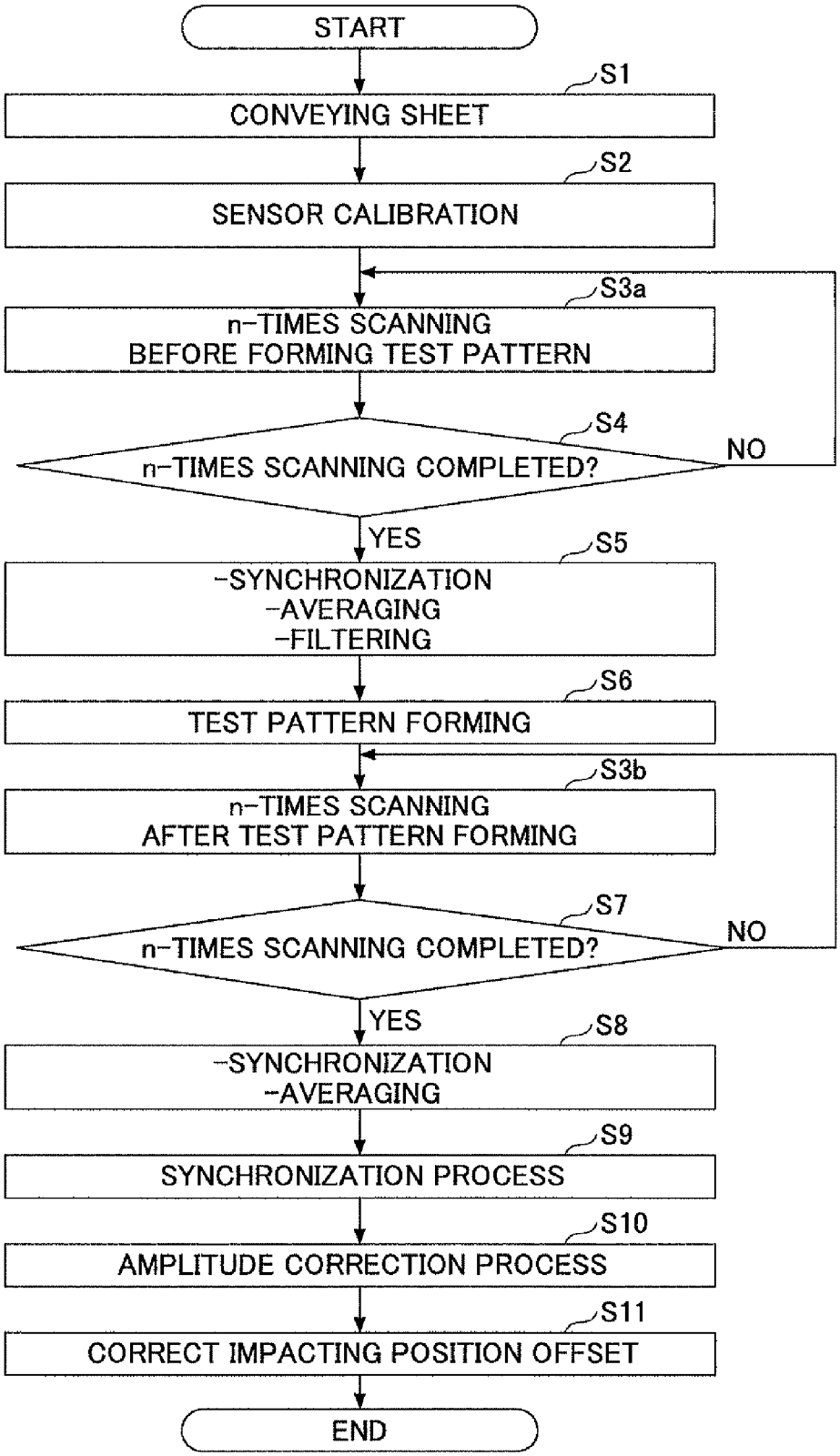
FIG. 23 is a flowchart which illustrates one example of a procedure in which a correction process executing unit corrects an amplitude.

FIG. 23 is a flowchart which illustrates one example of a procedure in which a correction process executing unit 526 corrects an amplitude.

First, the CPU 301 instructs the main controller 301 to start an impacting position offset correction. With this instruction, the main controller 310 drives the sub-scanning motor 132 via the sub-scanning drive unit 314 and conveys the sheet material 150 to right under the recording head 21 (S1).

Next, the main controller 310 drives the main scanning motor 27 via the main scanning drive unit 313 to move the carriage 5 over the sheet material 150 and carries out a calibration of a light emitting element and a light receiving element at a specific location on the sheet material 150 (S2).

Figure 24A:
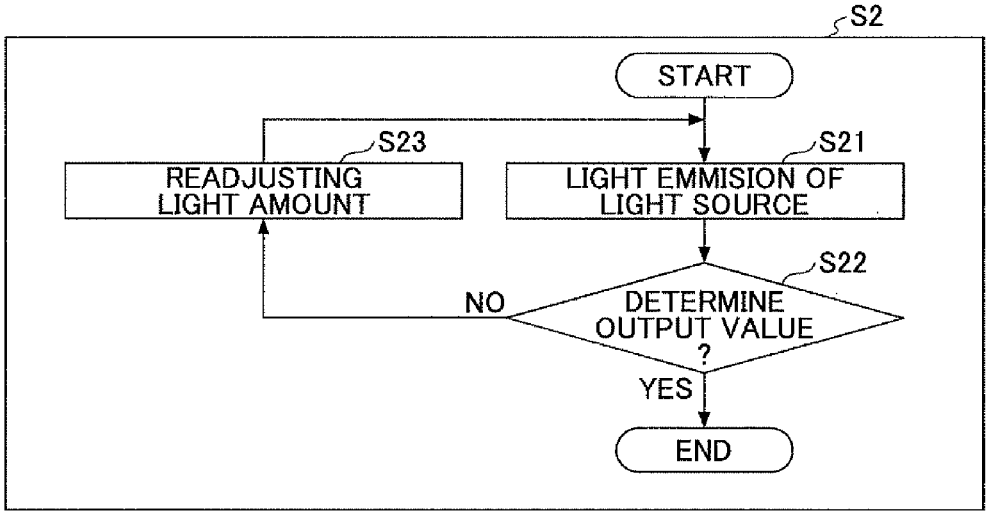
FIGS. 24A, 24B, 24C, and 24D are exemplary flowcharts which describe a process of the correction process executing unit.

FIG. 24A is an exemplary flowchart which explains a process in S2. A calibration is a process in which a light amount of the light emitting element is adjusted such that a detected voltage of the light emitting element falls within a desired range (more specifically, it is adjusted to fall within a range of 4±0.4 V).

A PWM value for driving the light emitting element 402 of the print position offset sensor 30 is set in the light emission controller 511 by the CPU 301, and smoothing is performed at the smoothing circuit 512, after which it is provided to the driving circuit 513, which drives the light emitting element 402 to emit light (S21).

An intensity signal which is detected by the light receiving element 403 of the print position offset sensor 30 is stored in the shared memory 525 and the CPU 301 determines whether it takes a desired voltage value (S22).

If it takes the desired voltage value (Yes in S22), the process of FIG. 24A ends. If it does not take the desired voltage value (No in S22), the CPU 301 changes the PWM value (S23) to readjust the light amount.

Next, an n-times scanning unit of the pre-print pre-processing unit 611 moves the carriage 5 to a home position and performs n-times scanning before forming the test pattern and stores n detected voltage data sets in the shared memory 525 (S3*a*).

Figure 24B:
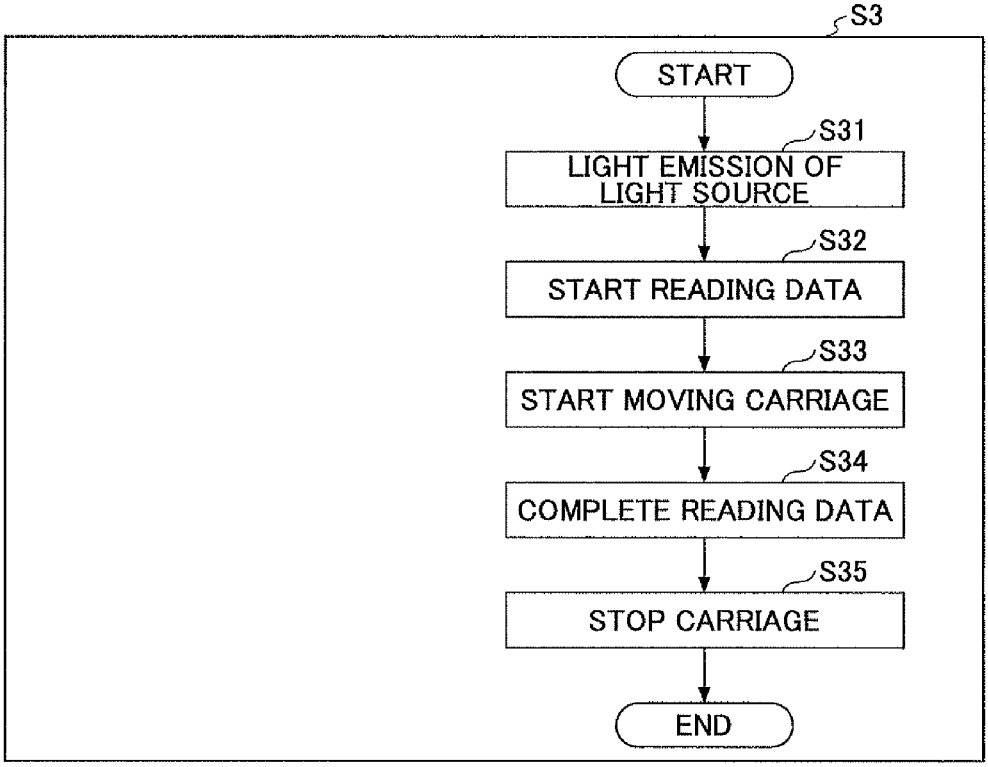

FIG. 24B is an exemplary flowchart which explains a process in S3. First, the CPU 301 turns on a sensor light source (S31).

Next, the photoelectric conversion circuit 521, etc., starts taking in the detected voltage data (S32). When the taking in is started, the main scanning drive unit 313 moves the carriage 5 with the main scanning drive motor 27 (S33). In other words, the photoelectric conversion circuit 521, etc., takes in the detected voltage data while the carriage 5 moves. The data is sampled at 20 KHz (a 50 μs interval), for example.

When the carriage 5 arrives at an edge of the image forming apparatus, the photoelectric conversion circuit 521, etc., completes taking in the detected voltage data (S34). The main controller 310 accumulates a series of detected voltage data sets in the shared memory 525. The main controller 310 stops the carriage 5 at the home position (S35).

The CPU 301 determines, for a predetermined number of times, whether. reading of the detected voltage data has been completed n times (S4), and, if yes, the process proceeds to the following process S5, and, if no, the process of reading the detected voltage data in S3 is performed again (S3*a*).

Figure 24C:
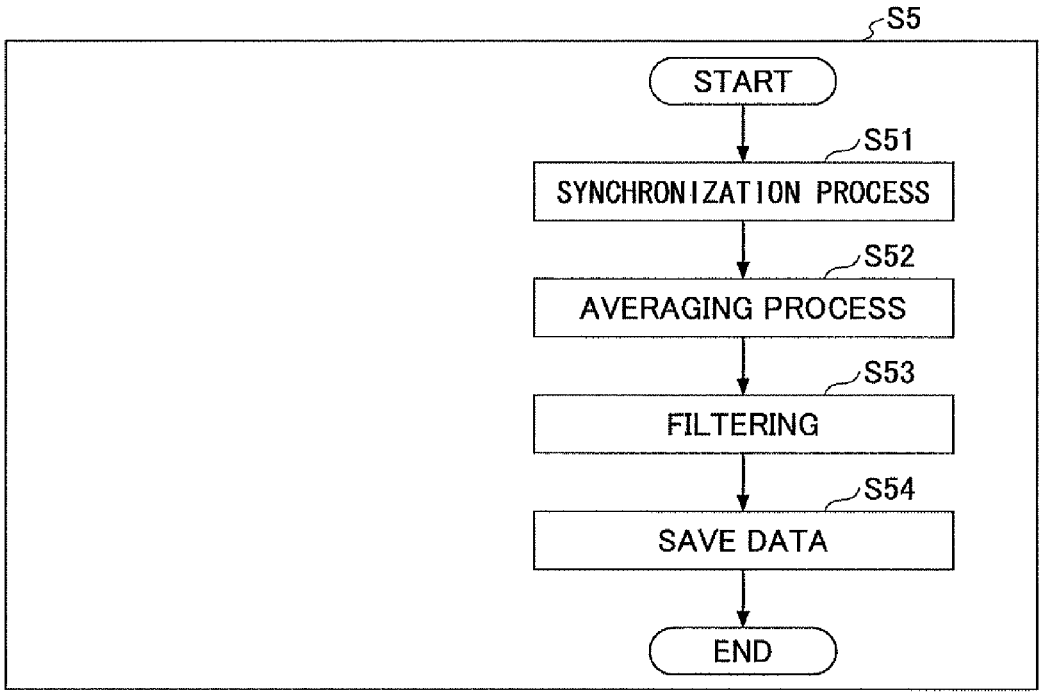

Next, the pre-print pre-processing unit 611 reads the detected voltage data, before test pattern forming, that are accumulated in the shared memory 525 and reads a predetermined number of times to execute the pre-processing and saves the data in the RAM 303 (S5). What is in the pre-processing in S5, which is shown in FIG. 24C, has already been explained, so that a repeated explanation is omitted.

Next, in the main controller 310 no sheet conveying is performed with a sub-scanning position of the sheet material 150 as it is, the main scanning controller 313 moves the carriage 5 via the main scanning drive motor 27, and the head drive controller 312 drives the recording heads 21-24 to form a test pattern for adjusting an impacting position offset (S6).

Next, an n-times scanning unit of the post-print pre-processing unit 612 moves the carriage 5 to a home position and performs n-times scanning after forming the test pattern and stores n detected voltage data sets in the shared memory 525 (S3*b*). What is in the process is the same as FIG. 24B.

The CPU 301 determines, for a predetermined number of times, whether reading of the detected voltage data has been completed n times (S7), and if yes, the process proceeds to the following process S8, and, if no, the process of reading the pattern data in S3 is performed again (S3*b*).

Figure 24D:
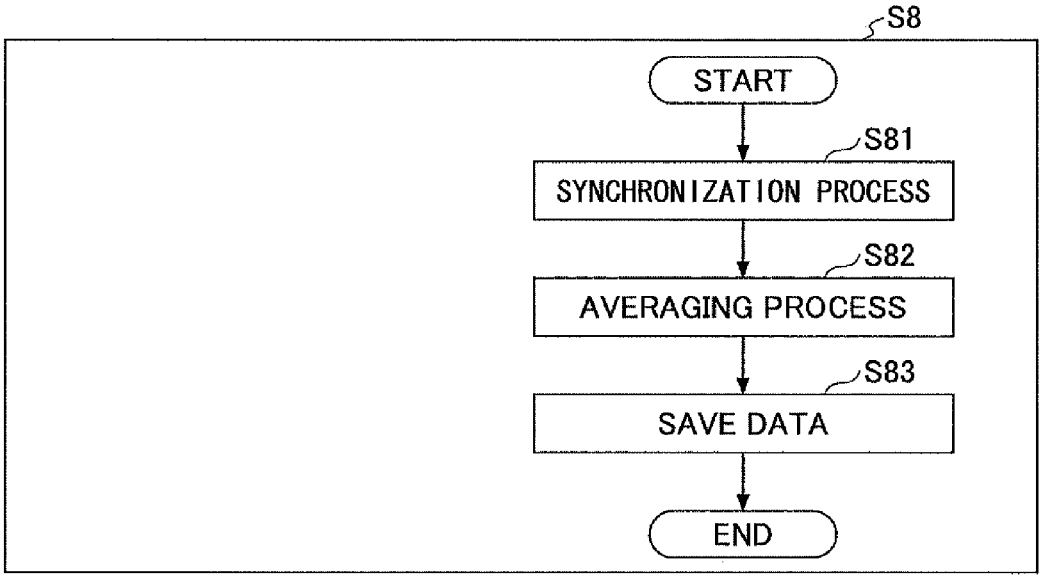

Next, the post-print pre-processing unit 612 reads the detected voltage data that are accumulated in the shared memory 525 and reads a predetermined number of times to carry out the pre-processing and saves the data in the RAM 303 (S8). What is in the pre-processing in S8, which is shown in FIG. 24D, has already been explained, so that a repeated explanation is omitted.

Next, the synchronization processing unit 613 reads, from the RAM 303, pattern measurement data and blank sheet measurement data to which the pre-processing is applied to perform position alignment by a synchronization process (S9).

Next, the amplitude correction processing unit 614 performs an operation of Equation (2) to perform an amplitude correction process (S10). In this way, detected voltage data z with all points of inflection falling within a threshold area have been obtained. The ejection timing correction unit 615 detects an edge position with the data z to be operated on, and corrects an impacting position offset of a liquid droplet (S11). In other words, the ejection timing correction unit 615 determines the intersecting points C1 and C2 from the lower-limit threshold Vrd and the upper-limit threshold Vru. A half-way point of the intersecting points C1 and C2 is a position of a line which makes up a test pattern. The ejection timing correction unit 615 compares a distance of each line with an optimal distance to calculate an impacting position offset amount, and calculates a correction value of a liquid droplet ejection timing for driving the recording head 21 such that an impacting position offset is removed.

As described above, the image forming apparatus 100 according to the present embodiment may correct an amplitude to cause a position of a point of inflection to fall within a threshold area, making it possible to accurately determine an edge position and accurately correct an impacting position offset of liquid droplets.

Embodiment 2

In the present embodiment, an amplitude correction process is described for an image forming system embodied by a server, not an image forming apparatus.

Figure 25:
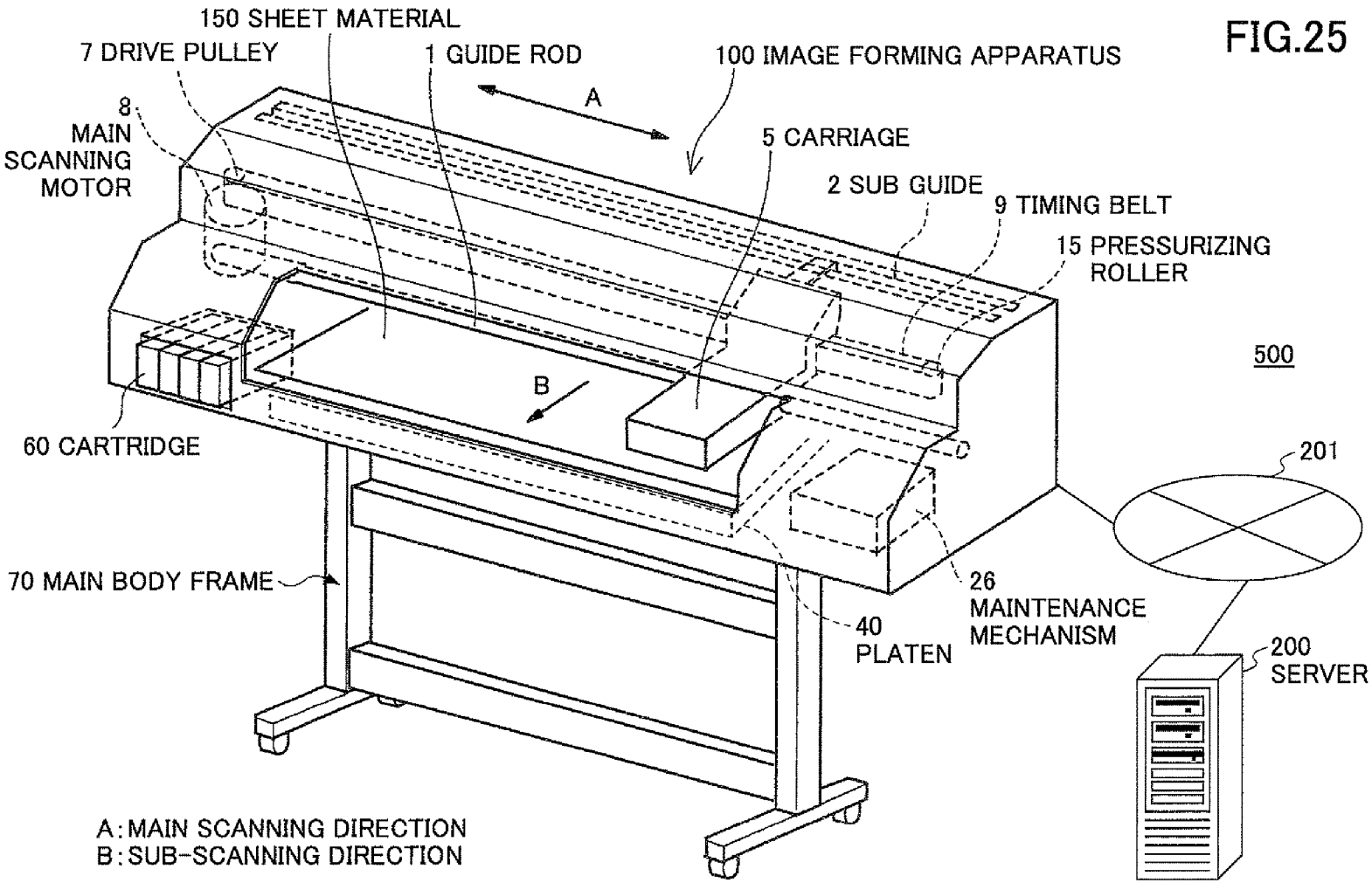
FIG. 25 is an exemplary diagram which schematically describes an image forming system which includes the image forming apparatus and a server.

FIG. 25 is an exemplary diagram which schematically describes an image forming system 500 which has an image forming apparatus 100 and a server 200. In FIG. 25, the same letters are given to the same elements as FIG. 3, so that a repeated explanation is omitted. The image forming apparatus 100 and the server 200 are connected via a network 201, which includes an in-house LAN; a WAN which connects the LAN; or the Internet, or a combination thereof.

In the image forming system 500 as in FIG. 25, the image forming apparatus 100 forms a test pattern and scans the test pattern by a print position offset sensor, and the server 200 calculates the correction value of the liquid droplet ejection timing. Therefore, a processing burden of the image forming apparatus 100 may be reduced and functions of calculating a correction value of a liquid droplet ejection timing may be concentrated in the server.

Figure 26:
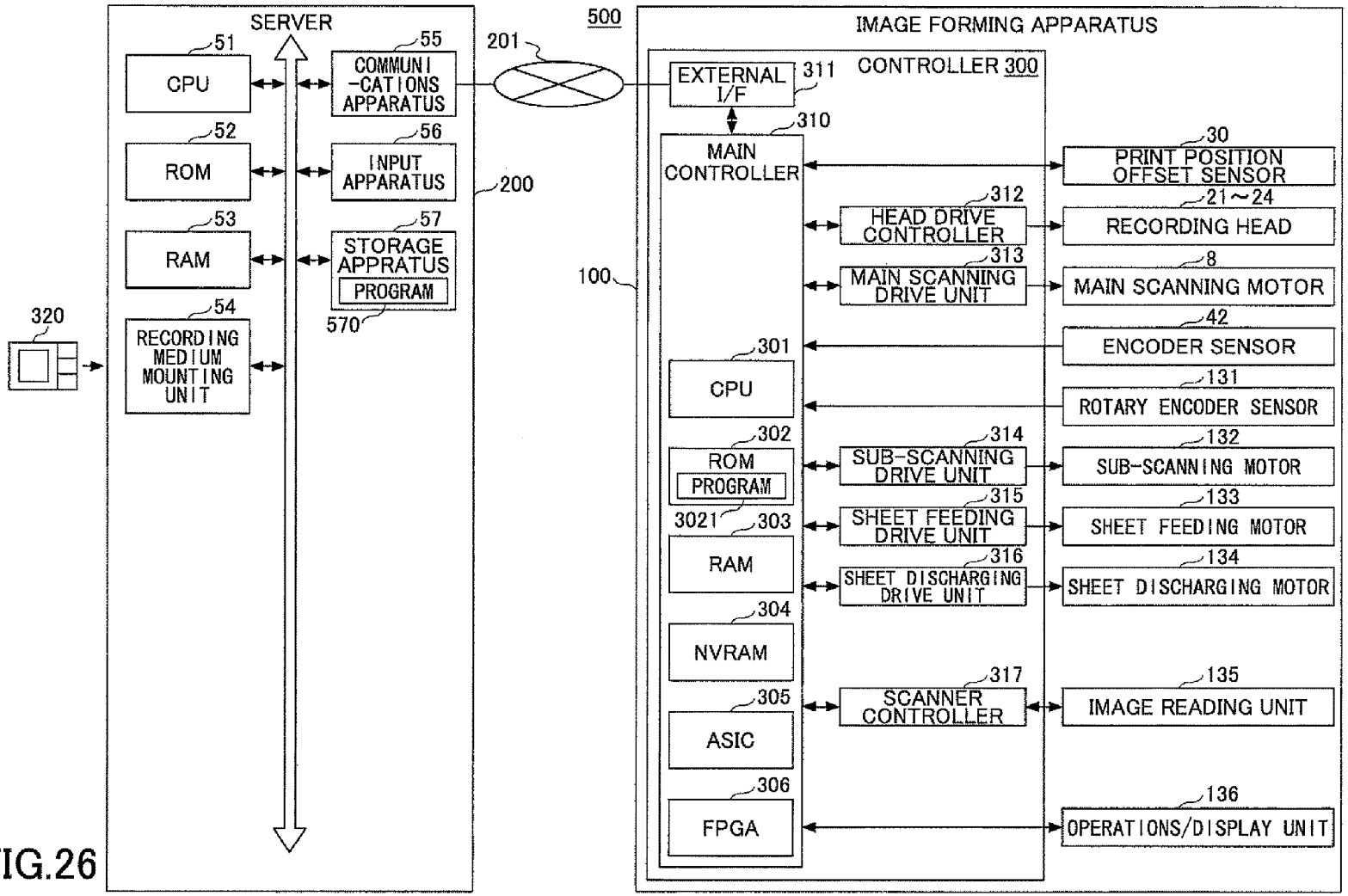
FIG. 26 is a diagram illustrating an example of a hardware configuration of the server and the image forming apparatus.

FIG. 26 is a diagram illustrating an example of a hardware configuration of the server 200 and the image forming apparatus 100. The server 200 includes a CPU 51, a ROM 52, a RAM 53, a recording medium mounting unit 54, a communications apparatus 55, an input apparatus 56, and a storage apparatus 57, which are connected by a bus. The CPU 51 reads an OS (Operating System) and a program 570 from the storage apparatus 57 to execute the program with the RAM 53 as a working memory. The program 570 performs a process which is the same as the process in Embodiment 1.

The RAM 53 becomes a working memory (a main storage memory) which temporarily stores necessary data, while a BIOS, initializing data, a bootstrap loader, etc., are stored in the ROM 52. The storage medium mounting unit 54 is an interface in which is mounted a portable storage medium 320.

The communications apparatus 55, which is called a LAN card or an Ethernet card, connects to the network 201 to communicate with an external I/F 311 of the image forming apparatus 100. A domain name or an IP address of the server 200 is registered.

The input apparatus 56 is a user interface which accepts various operating instructions of the user, such as a keyboard, mouse, etc. It may also be arranged for a touch panel or a voice input apparatus to be the input apparatus.

The storage apparatus 57 is a non-volatile memory such as a HDD (Hard Disk Drive), a flash memory, etc., storing an OS, a program, etc. The program 570 is distributed in a form recorded in the storage medium 320, or in a manner such that it is downloaded from the server 200 (not shown).

Figure 27:
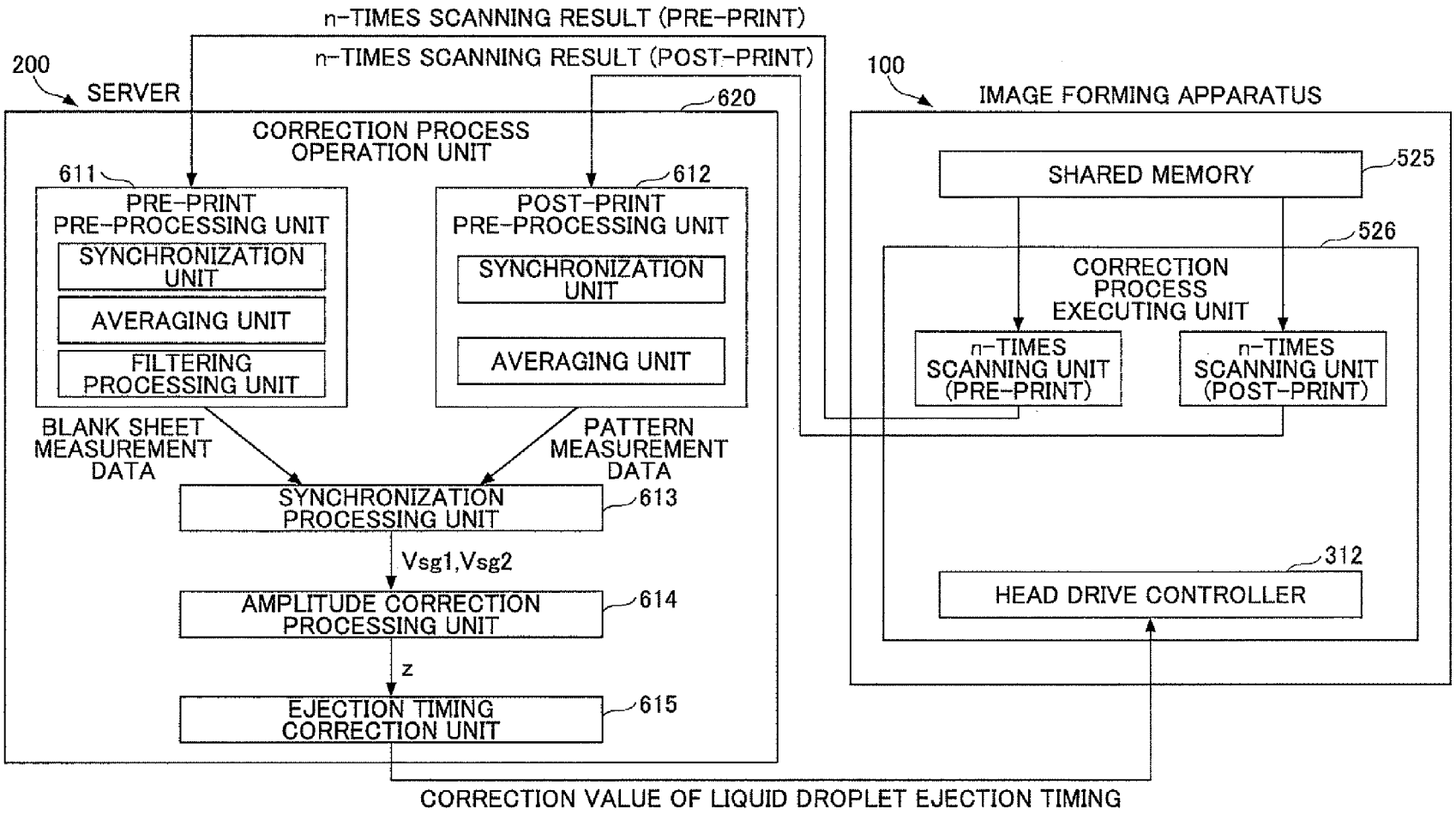
FIG. 27 is an exemplary functional block diagram of the image forming system.

FIG. 27 is an exemplary functional block diagram of the image forming system 500. The correction process executing unit of the image forming apparatus 100 retains the pre-print and post-print n-times scanning unit, while the server side includes the other functions. A function at the server side is called a correction process operating unit 620.

The correction process operating unit 620 includes, for a pre-print process, synchronization, averaging, and filtering units 611, and, for a post-print process, synchronization and averaging units 612, a synchronization process unit 613, an amplitude correction process unit 614, and an ejection timing correction unit 615. A function of each block is the same as Embodiment 1, so that a repeated explanation is omitted.

In the image forming system 500, an n-times scanning unit on the image forming apparatus side transmits, to the server 200, n pre-print and post-print data sets. The correction process operating unit 620 on the server side performs an amplitude correction process to calculate a correction value of a liquid droplet ejection timing. The server 200 transmits the correction value of the liquid droplet ejection timing to the image forming apparatus 100, so that the head drive controller 312 may change the ejection timing.

FIG. 28 is a flowchart which shows an operational procedure of the image forming system 500. As shown, S5 and S8-S11 in FIG. 24 are performed by the server 200, while a process required for the other pre-print and post-print n-times scanning is performed by the image forming apparatus 100.

Moreover, the image forming apparatus 100 and the server 200 communicate, so that the image forming apparatus 100 newly performs a process which transmits n pre-print scanning results in step S4-1 and a process which transmits n post-print scanning results in step S7-1. Moreover, the image forming apparatus 100 newly performs a process which receives a correction value of the liquid droplet ejection timing in Step S7-2.

In the meantime, the server 200 performs an amplitude correction process in S10, and, after S11, a correction value of the liquid droplet ejection timing is transmitted to the image forming apparatus 100 in S12.

In this way, with only a change in where the process is performed, the image forming system 500 may suppress an impact received from a characteristic of a sheet material as in Embodiment 1, to accurately correct the liquid droplet ejection timing.

The present application is based on Japanese Priority Applications No. 2011-038743 filed on Feb. 24, 2011, and No. 2011-276400 filed on Dec. 16, 2011, the entire contents of which are hereby incorporated by reference.

The invention claimed is:

1. An image forming apparatus which reads a test pattern formed by ejecting liquid droplets onto a recording medium to adjust an ejection timing of the liquid droplets, comprising:

a reading unit including a light emitting unit which irradiates a light onto the recording medium, and a light receiving unit which receives a reflected light from the recording medium, a relative movement unit which relatively moves the recording medium or the reading unit at a constant speed, a second detected data obtaining unit which obtains one or more second detected data sets of the reflected light which is received from a scanning position of the light by the light receiving unit while the reading unit moves relatively with respect to the recording medium before the test pattern is formed;

a first detected data obtaining unit which obtains one or more first detected data sets of the reflected light which is received by the light receiving unit when the light moves over the test pattern at generally the same scanning position as the scanning position while the reading unit moves relatively with respect to the recording medium after the test pattern is formed; and a signal correction unit which calculates a proportion of the first detected data sets relative to the second detected data sets to align a local maximum value of the first detected data sets such that the local maximum value is generally constant.

2. The image forming apparatus as claimed in claim 1, wherein the signal correction unit multiplies a set voltage value with the proportion to generate data for determining a test pattern position, the data having a generally constant amplitude.

3. The image forming apparatus as claimed in claim 2, wherein the set voltage value is a statistical value of the second detected data sets which are obtained multiple times by the second detected data obtaining unit.

4. The image forming apparatus as claimed in claim 2, further comprising:

a position detection unit which statistically processes the data for determining the test pattern position in a neighborhood of a point at which a change of the data for determining the test pattern position becomes the largest that are included between an upper-limit threshold and a lower-limit threshold of the data for determining the test pattern position to detect a position of the test pattern.

5. The image forming apparatus as claimed in claim 1, further comprising a synchronization processing unit which performs a position alignment of the first detected data sets and the second detected data sets.

6. The image forming apparatus as claimed in claim 1, wherein the second detected data obtaining unit obtains the second detected data set multiple times to align an edge of the second detected data sets and perform an averaging process thereon for each of the scanning positions to obtain the second detected data set.

7. The image forming apparatus as claimed in claim 1, wherein the second detected data obtaining unit sets a point at which the second detected data set first takes a value which is no less than a set value as an edge of the respective second detected data sets.

8. The image forming apparatus as claimed in claim 1, wherein the first detected data obtaining unit obtains the first detected data set multiple times to perfoi in a synchronization process which relatively offsets the scanning position to minimize a difference of the first detected data sets and perform an averaging process thereon for the same scanning position to obtain the first detected data set.

9. The image forming apparatus as claimed in claim 6, further comprising a position detection sensor which detects a relative position of the reading unit relative to the recording medium, wherein the first detected data obtaining unit or the second detected data obtaining unit matches the relative position of the first detected data sets or the second detected data sets.

10. A method of detecting a pattern position of an image forming apparatus, the image forming apparatus including a reading unit which includes a light emitting unit which irradiates a light onto a recording medium and a light receiving unit which receives a reflected light from the recording medium, the image forming apparatus reading a test pattern formed by ejecting liquid droplets onto the recording medium to adjust an ejection timing of the liquid droplets, the method comprising:

relatively moving, by a relative movement unit, the recording medium or the reading unit at a constant speed;

obtaining, by a second detected data obtaining unit, one or more second detected data sets of the reflected light which is received from a scanning position of the light by the light receiving unit while the reading unit moves relatively with respect to the recording medium before the test pattern is formed;

obtaining, by a first detected data obtaining unit, one or more first detected data sets of the reflected light which is received by the light receiving unit when the light moves over the test pattern at generally the same scanning position as the scanning position while the reading unit moves relatively with respect to the recording medium after the test pattern is formed; and calculating, by a signal correction unit, a proportion of the first detected data sets relative to the second detected data sets to align a local maximum value of the first detected data sets such that the local maximum value is generally constant.

11. An image forming system which reads a test pattern formed by ejecting liquid droplets onto a recording medium to adjust an ejection timing of the liquid droplets, comprising:

an image forming apparatus including a reading unit which includes a light emitting unit which irradiates a light onto the recording medium and a light receiving unit which receives a reflected light from the recording medium;

a relative movement unit which relatively moves the recording medium or the reading unit at a constant speed;

a second detected data obtaining unit which obtains one or more second detected data sets of the reflected light which is received from a scanning position of the light by the light receiving unit while the reading unit moves relatively with respect to the recording medium before the test pattern is formed;

a first detected data obtaining unit which obtains one or more first detected data sets of the reflected light which is received by the light receiving unit when the light moves over the test pattern at generally the same scanning position as the scanning position while the reading unit moves relatively with respect to the recording medium after the test pattern is formed; and a signal correction unit which calculates a proportion of the first detected data sets relative to the second detected data sets to align a local maximum value of the first detected data sets such that the local maximum value is generally constant.

* * * * *